US011605888B2

(12) United States Patent
Li

(10) Patent No.: US 11,605,888 B2
(45) Date of Patent: Mar. 14, 2023

(54) ANTENNA CIRCUIT AND MOBILE TERMINAL

(71) Applicant: VIVO MOBILE COMMUNICATION CO., LTD., Chang'an Dongguan (CN)

(72) Inventor: Rihui Li, Chang'an Dongguan (CN)

(73) Assignee: VIVO MOBILE COMMUNICATION CO., LTD., Guangdong (CN)

( * ) Notice: Subject to any disclaimer, the term of this patent is extended or adjusted under 35 U.S.C. 154(b) by 626 days.

(21) Appl. No.: 16/625,523

(22) PCT Filed: May 21, 2018

(86) PCT No.: PCT/CN2018/087637
§ 371 (c)(1),
(2) Date: Dec. 20, 2019

(87) PCT Pub. No.: WO2018/233420
PCT Pub. Date: Dec. 27, 2018

(65) Prior Publication Data

US 2021/0384626 A1 Dec. 9, 2021

(30) Foreign Application Priority Data

Jun. 22, 2017 (CN) ..... 201710481298.6

(51) Int. Cl.
*H01Q 1/24* (2006.01)
*H01Q 5/335* (2015.01)
(Continued)

(52) U.S. Cl.
CPC ..... *H01Q 5/335* (2015.01); *H01Q 1/243* (2013.01); *H01Q 5/328* (2015.01); *H01Q 9/42* (2013.01)

(58) Field of Classification Search
CPC ..... H01Q 1/243; H01Q 5/328; H01Q 5/335
See application file for complete search history.

(56) References Cited

U.S. PATENT DOCUMENTS

2014/0306855 A1 10/2014 Tsai et al.
2014/0335916 A1 11/2014 Thorson et al.
(Continued)

FOREIGN PATENT DOCUMENTS

CN 103904433 A 7/2014
CN 105896083 A 8/2016
(Continued)

OTHER PUBLICATIONS

Extended European Search Report related to Application No. 18820854.0 dated May 8, 2020.
(Continued)

*Primary Examiner* — Graham P Smith
(74) *Attorney, Agent, or Firm* — von Briesen & Roper, s.c.

(57) ABSTRACT

The present disclosure provides an antenna circuit and a mobile terminal. The antenna circuit includes: an antenna unit; a switching circuit connection point and a feed point are arranged on the antenna unit; an antenna feed is connected with the feed point; a first tuning circuit is connected with the switching circuit connection point, the first tuning circuit is configured to increase a bandwidth of a single resonant mode in an intermediate-high frequency and/or to tune a resonant frequency in the intermediate-high frequency; wherein a distance from the feed point to the end of the antenna unit is larger than a distance from the switching circuit connection point to the end of the antenna unit.

19 Claims, 14 Drawing Sheets

(51) Int. Cl.
*H01Q 5/328* (2015.01)
*H01Q 9/42* (2006.01)

(56) References Cited

U.S. PATENT DOCUMENTS

| | | | | |
|---|---|---|---|---|
| 2015/0057054 | A1 | 2/2015 | Su et al. | |
| 2015/0372656 | A1 | 12/2015 | Mow et al. | |
| 2017/0019137 | A1 | 1/2017 | Parkhurst et al. | |
| 2017/0141469 | A1* | 5/2017 | Huang | H01Q 1/38 |
| 2017/0187111 | A1 | 6/2017 | Noh et al. | |

FOREIGN PATENT DOCUMENTS

| | | | |
|---|---|---|---|
| CN | 205583147 | U | 9/2016 |
| CN | 106256088 | A | 12/2016 |
| CN | 106575970 | A | 4/2017 |
| CN | 106711583 | A | 5/2017 |
| CN | 106876897 | A | 6/2017 |
| CN | 107331979 | A | 11/2017 |
| WO | WO 2016/035994 | A1 | 3/2016 |

OTHER PUBLICATIONS

International Search Report related to Application No. PCT/CN2018/087637 dated Jun. 28, 2018.
Chinese Search Report related to Application No. 201710481298.6 dated May 23, 2018.

* cited by examiner

ANTENNA CIRCUIT AND MOBILE TERMINAL

CROSS-REFERENCE TO RELATED APPLICATION

This patent application is a 35 USC §371 U.S. national stage of International Application No. PCT/CN2018/087637 filed on May 21, 2018, which claims priority to Chinese Patent Application No. 201710481298.6 filed with the Chinese Patent Office on Jun. 22, 2017, which are incorporated by reference herein.

TECHNICAL FIELD

The present disclosure relates to the field of mobile terminal antenna technology, in particular to an antenna circuit and a mobile terminal.

BACKGROUND

In order to improve a network access speed of a mobile terminal, multi-carrier aggregation (CA) technology has been popularized, such as an "intermediate-frequency+high-frequency" CA combination of B39+B41 proposed by China Mobile Communications Group Co., Ltd, and recently, Chinese telecom operators have proposed a certain band in a low frequency (0.7 Ghz-0.96 Ghz), such as B5, which combines an intermediate frequency (1.71 G-2.17 G), such as B1 and B3, to form a "low-frequency+intermediate-frequency" CA combination. In the future, it is possible for telecom operators to introduce a combination of "low-frequency+high-frequency" CA. The multi-CA technology requires a mobile terminal antenna to support these bands at the same time, rather than a conventional time-sharing support, which brings great challenges to the mobile terminal antenna.

In recent years, the mobile terminal with an integrated full-metal structure (such as a three-part integrated metal structure, an integrated metal structure with a U-shaped slot) has been favored in a market, which also brings great challenges to the antenna, because a bandwidth of the intermediate frequency and the low frequency of the mobile terminal with the integrated full-metal structure is usually very narrow. Implementation of multi-CA antenna is still a difficult problem in the industry.

FIG. 1 shows the integrated full-metal structure with the U-shaped slot, FIG. 2 shows the three-part integrated full-metal structure, FIG. 3 shows a metal battery cover shape with a medium frame. An existing antenna scheme of the mobile terminal with the integrated full-metal structure is shown in FIG. 4, the antenna scheme includes: an antenna unit 40, point A of the antenna unit is the end of the antenna unit 40, point C (i.e. feed point) of the antenna unit is connected with an antenna matching circuit 41, a terminal of the antenna matching circuit 41 is connected with an antenna feed 42, point B (i.e. switch circuit connection point) of the antenna unit is connected with a low-frequency/intermediate-high-frequency switching circuit 43, point D of the antenna unit 40 is electrically connected with a tuning circuit 44, point E of the antenna unit is grounded. The low-frequency/intermediate-high-frequency switching circuit 43 completes a switching between the low frequency and the intermediate-high frequency (low frequency is 0.7 G-0.96 G, intermediate-high frequency is 1.71 G-2.69 G). Specifically, there is a switch inside the low-frequency/intermediate-high frequency switching circuit 43, and the switch is turned off in the low frequency and turned on in the high frequency. The tuning circuit 44 realizes tuning in the low frequency or in the intermediate-high frequency (1.71 G-2.69 G). There is a single-pole multi-throw switch in the tuning circuit 44. Each switch branch is connected with at least one inductor or capacitor. By switching different switch branches to grounding, the low-frequency or intermediate-high-frequency tuning may be realized to cover different band requirements. For example, when the switch inside the low-frequency/intermediate-high-frequency switching circuit is turned off, a low-frequency tuning state is entered. As shown in FIG. 5, a switch branch 1 is turned on to cover B12 (0.7 G-0.746 G), a branch 2 is turned on to cover B5 (0.824 G-0.894 G), and a branch 3 is turned on to cover B8 (0.88 G-0.96 G). When the switch inside the low-frequency/intermediate-high-frequency switching circuit is turned on, an intermediate-high-frequency tuning state is entered. For example, a branch 4 is turned on to cover B3+B1 (1.71 G-2.17 G) and a branch 5 is turned on to cover B40+B41 (2.3 G-2.69 G). Generally speaking, in the mobile terminal, a length of A-C of the antenna unit is about 5 mm-25 mm, a length of A-B is about 10 mm-25 mm, a length of A-E is about 35 mm-55 mm, a length of D-E is about 5 mm-25 mm, and a length of D-B is generally larger than 15 mm.

However, the existing antenna has insufficient bandwidth in the intermediate frequency or the high frequency, which affects the performance of the antenna.

SUMMARY

The embodiments of the present disclosure provide an antenna circuit and a mobile terminal to solve a problem that a bandwidth of an antenna in the intermediate frequency or the high frequency is insufficient and an antenna performance is affected.

In one aspect, the embodiments of the present disclosure provide an antenna circuit, including: an antenna unit; a switching circuit connection point and a feed point are arranged on the antenna unit; an antenna feed is connected with the feed point; a first tuning circuit is connected with the switching circuit connection point, the first tuning circuit is configured to increase a bandwidth of a single resonant mode in an intermediate-high frequency and/or to tune a resonant frequency in the intermediate-high frequency; wherein a distance from the feed point to the end of the antenna unit is larger than a distance from the switching circuit connection point to the end of the antenna unit.

In another aspect, the embodiments of the present disclosure further provide a mobile terminal including the antenna circuit described above.

In the embodiments of the present disclosure, the feed point is set closer to a grounding end of the antenna unit by exchanging positions of the switching circuit connection point and the feed point of the antenna unit, thereby solving the problem of insufficient bandwidth of the antenna in the intermediate frequency or the high frequency. Therefore, the bandwidth of the intermediate frequency and the high frequency is improved effectively, and the performance of the antenna is also improved.

BRIEF DESCRIPTION OF THE DRAWINGS

In order to clearly illustrate the technical solution of the embodiments of the present disclosure, a brief introduction of the accompanying drawings to be used in a description of the embodiments of the present disclosure will be given below. Obviously, the accompanying drawings described below are only some of the embodiments of the present disclosure, and for those ordinary skilled in the art, without creative work, other drawings may also be obtained from these drawings.

DETAILED DESCRIPTION

The technical solutions in the embodiments of the present disclosure will be described hereinafter clearly and completely with reference to the accompanying drawings of the embodiments of the present disclosure. Obviously, the embodiments described above are part of the embodiments of the present disclosure, not all of them. Based on the embodiments of the present disclosure, all other embodiments acquired by those ordinary skilled in the art without creative work will fall into the protection scope of the present disclosure.

Figure 1:
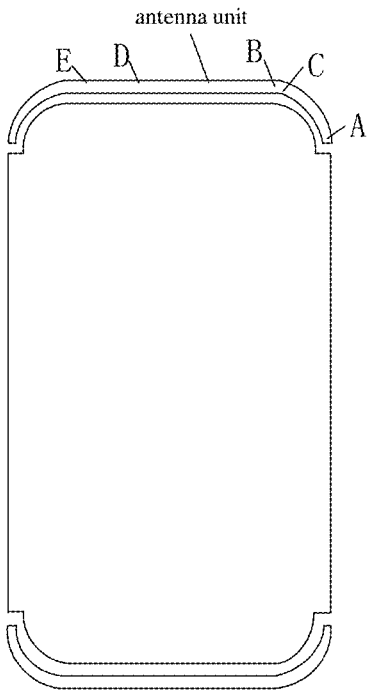
FIG. 1 is a schematic diagram illustrating a structure of a mobile terminal with an integrated full-metal structure with a U-shaped slot according to embodiments of the present disclosure.
Figure 2:
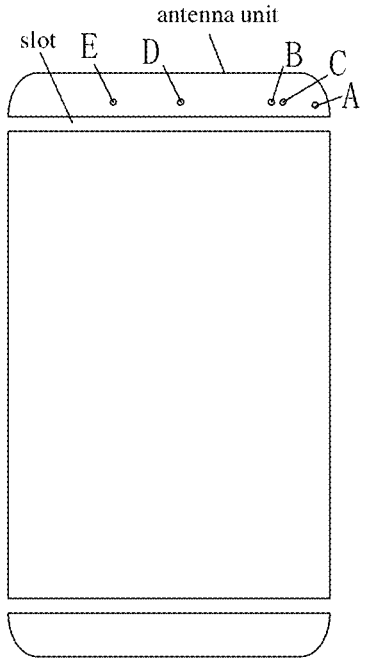
FIG. 2 is a schematic diagram illustrating a structure of a mobile terminal with a three-part integrated full-metal structure according to embodiments of the present disclosure.
Figure 3:
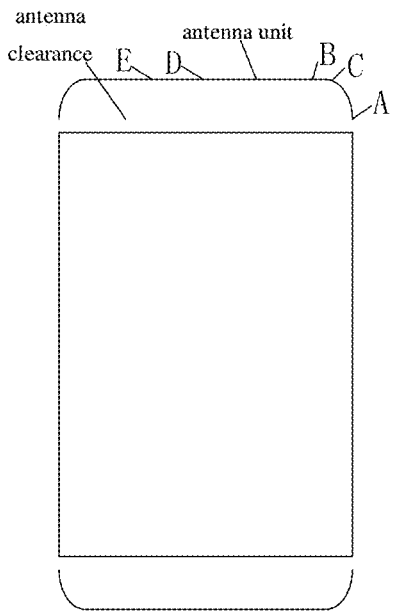
FIG. 3 is a schematic diagram illustrating a structure of a mobile terminal with a metal battery cover shape with a medium frame according to embodiments of the present disclosure.
Figure 4:
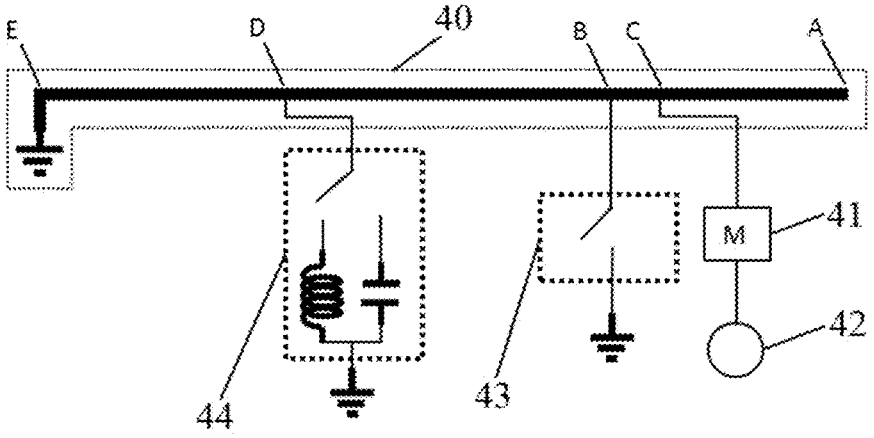
FIG. 4 is a schematic diagram illustrating a composition of an antenna structure.
Figure 5:
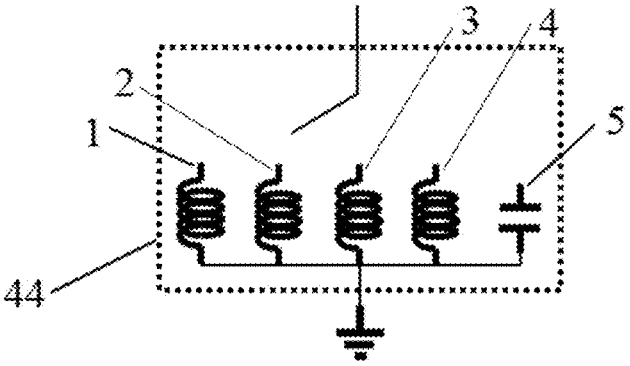
FIG. 5 is a schematic diagram illustrating a composition of a tuning circuit.
Figure 6:
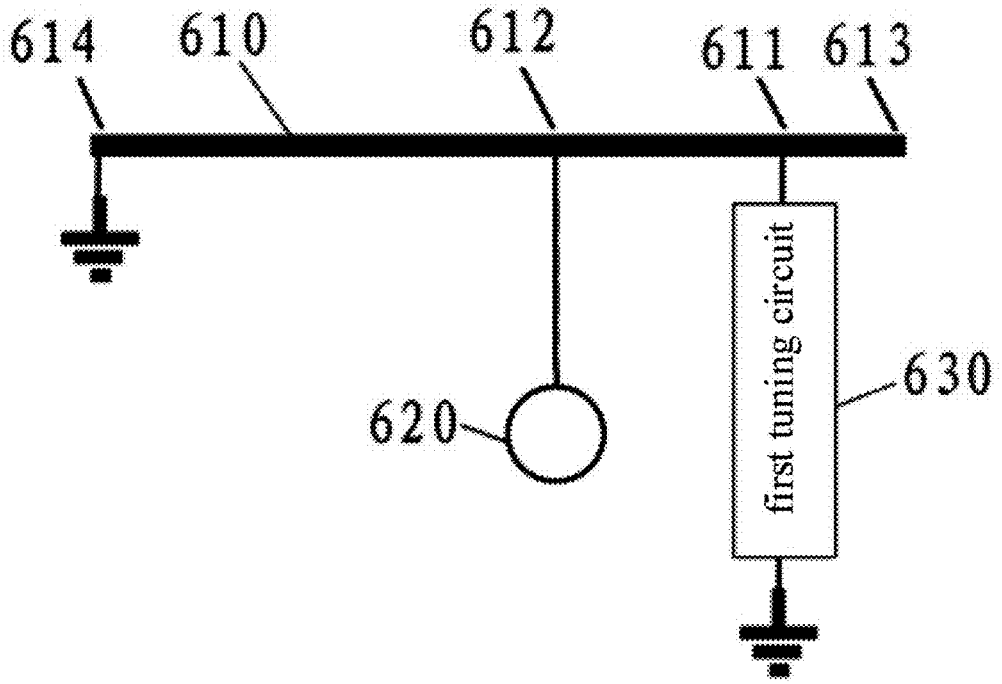
FIG. 6 is a schematic diagram illustrating a structure of an antenna circuit according to one embodiment of the present disclosure.

As shown in FIG. 6, the embodiment of the present disclosure provides an antenna circuit, includes: an antenna unit 610; a switching circuit connection point 611 and a feed point 612 are arranged on the antenna unit 610; an antenna feed 620 is connected with the feed point 612; a first tuning circuit 630 is connected with the switching circuit connection point 611, the first tuning circuit 630 is configured to increase a bandwidth of a single resonant mode in an intermediate-high frequency and/or to tune a resonant frequency in the intermediate-high frequency; wherein a distance from the feed point 612 to the end 613 of the antenna unit is larger than a distance from the switching circuit connection point 611 to the end 613 of the antenna unit.

Generally, a length of the antenna unit 610 ranges from 35 mm-60 mm, and a typical value is 50 mm. The length will significantly affect the resonant frequencies in a low frequency and a high frequency. In the embodiment, the distance from the feed point 612 to the end 613 of the antenna unit is set to be 15 mm to 30 mm, in some optional embodiments, is set to be 23 mm. The distance from the switch circuit connection point 611 to the end 613 of the antenna unit is set to be 5 mm to 18 mm, and in some optional embodiments, is set to be 12 mm. In the present embodiment, it is required that the distance from the feed point 612 to the end 613 of the antenna unit is larger than the distance from the switching circuit connection point 611 to the end 613 of the antenna unit.

In the present embodiment, the feed point 612 is set closer to a grounding end 614 of the antenna unit (the grounding end 614 of the antenna unit is opposite to the end 613 of the antenna unit) by switching positions of the switching circuit connection point 611 and the feed point 612 of the antenna unit 610, thereby solving the problem that the bandwidth of the antenna in the intermediate frequency or the high frequency is insufficient. Therefore, the bandwidth of the intermediate frequency and the high frequency is increased effectively, and the performance of the antenna is also improved.

Figure 7:
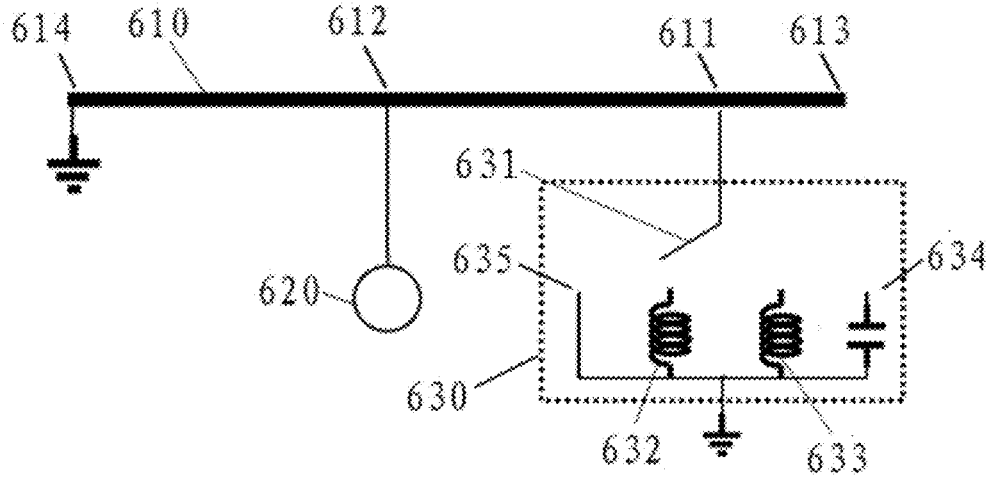
FIG. 7 is a schematic diagram illustrating a structure of an antenna circuit according to one embodiment of the present disclosure.

As shown in FIG. 7, the first tuning circuit 630 includes: a first switch 631, a first inductor 632, a second inductor 633, a first capacitor 634 and a first through line 635; wherein a first terminal of the first inductor 632, a first terminal of the second inductor 633, a first terminal of the first capacitor 634 and a first end of the first through line 635 are connected at a first connection point, and the first connection point is grounded; a first terminal of the first switch 631 is connected with the switching circuit connection point 611, a second terminal of the first switch 631 is connected with at least one of a second terminal of the first inductor 632, a second terminal of the second inductor 633, a second terminal of the first capacitor 634 and a second end of the first through line 635, or the second terminal of the first switch 631 is not connected with any of the second terminal of the first inductor 632, the second terminal of the second inductor 633, the second terminal of the first capacitor 634 and the second end of the first through line 635; when the second terminal of the first switch 631 is connected with at least one of the second terminal of the first inductor 632, the second terminal of the second inductor 633, the second terminal of the first capacitor 634 and the second end of the first through line 635, the bandwidth of the single resonant mode in the intermediate-high frequency is increased; when the second terminal of the first switch 631 is connected with another one or more of the second terminal of the first inductor 632, the second terminal of the second inductor 633, the second terminal of the first capacitor 634 and the second end of the first through line 635, the resonant frequency in the intermediate-high frequency is tuned.

It should be noted that, when the first tuning circuit 630 is configured to increase the bandwidth of the single resonant mode in the intermediate-high frequency, the second terminal of the first switch 631 is connected with one of the second terminal of the first inductor 632, the second terminal of the second inductor 633, the second terminal of the first capacitor 634 and the second end of the first through line 635. In this case, the first tuning circuit 630 is equivalent to an inductor, a capacitor or a resistor, the inductor is a fixed inductor, the capacitor is a fixed capacitor, and the resistor is a 0-ohm resistor; for example, when in B3 (1.71 G-1.88 G), a switching circuit includes an inductor of 6.8 nH; when in B40, the switching circuit includes the 0-ohm resistor; when in B41, the switching circuit includes a capacitor of 8.2 pf. It should be noted that, specific values of the devices in the switching circuit should be determined according to an actual antenna debugging.

Figure 8:
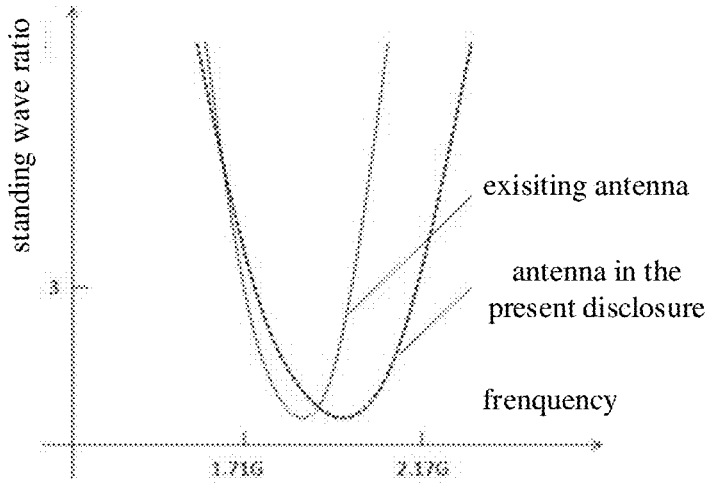
FIG. 8 is a schematic diagram illustrating an improvement of an antenna bandwidth.

It should be noted that, in this case, the antenna bandwidth of the single resonant mode may be increased, for example, as shown in FIG. 8, FIG. 8 is a schematic diagram illustrating an improvement of an antenna bandwidth, wherein, the solid line shows a schematic diagram of a standing wave ratio of an existing antenna, and the dashed line shows a schematic diagram of a standing wave ratio of an antenna in the embodiment of the present disclosure.

When the first tuning circuit 630 is configured to tune the resonant frequency in the intermediate-high frequency, in order to expand the bandwidth of the intermediate-high frequency, the second terminal of the first switch 631 is connected with another one or more of the second terminal of the first inductor 632, the second terminal of the second inductor 633, the second terminal of the first capacitor 634 and the second end of the first through line 635, the first switch 631 is single-pole multi-throw switch, the first inductor 632 has an inductance of 6.8 nH, the second inductor 633 has an inductance of 3.9 nH, the first capacitor 634 has a capacitance of 8.2 pf, the first through line 635, the first inductor 632, the second inductor 633 and the first capacitor 634 are turned on to operate in B40, B3, B1, B41, respectively. When the first through line 635, the first inductor 632, the second inductor 633 and the first capacitor 634 are turned off, the first tuning circuit 630 operates in the low frequency.

Figure 9:
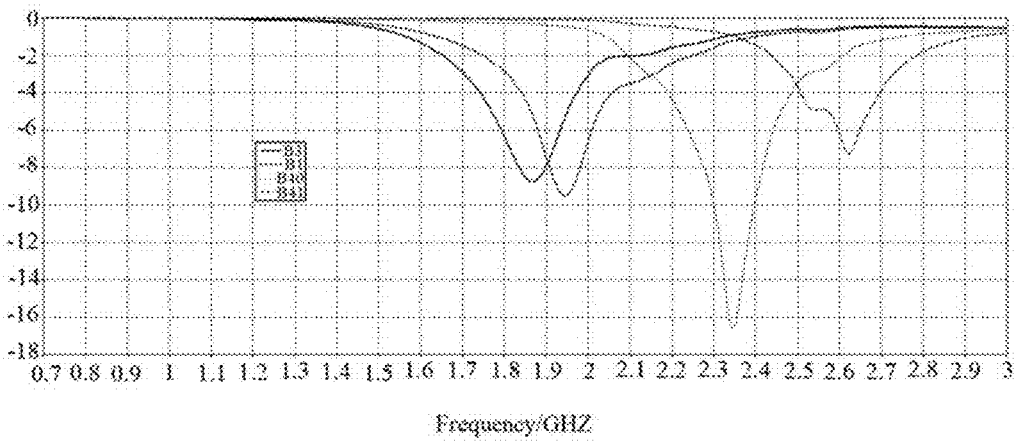
FIG. 9 is a schematic diagram illustrating tuning in a low frequency and an intermediate frequency.

A schematic diagram illustrating tuning in the low frequency and the intermediate frequency is shown in FIG. 9 (four tuning states have been achieved).

Figure 10:
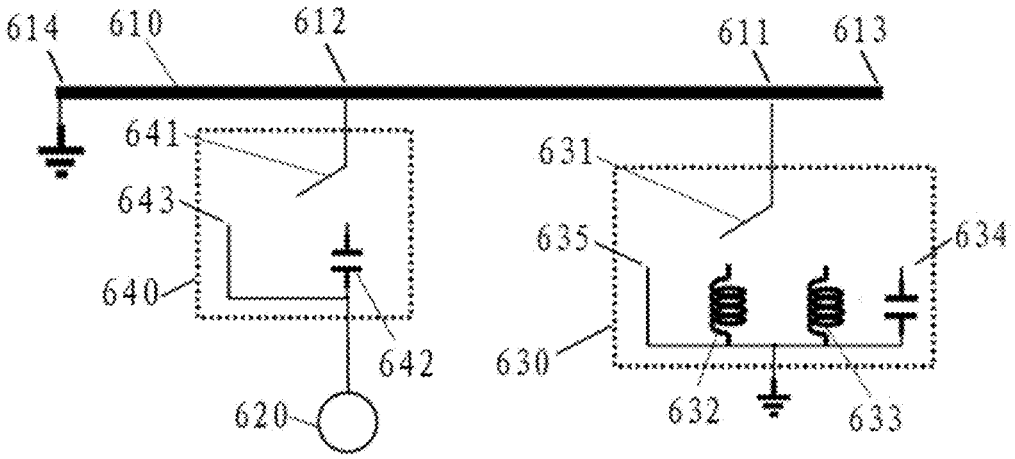
FIG. 10 is a schematic diagram illustrating a structure of an antenna circuit according to one embodiment of the present disclosure.

In some optional embodiments, as shown in FIG. 10, the antenna circuit of the embodiment of the present disclosure also includes: a second tuning circuit 640, a first terminal of the second tuning circuit 640 is connected with the feed point 612, and a second terminal of the second tuning circuit 640 is connected with the antenna feed 620; wherein, when the second terminal of the first switch 631 is connected with at least one of the second terminal of the first inductor 632, the second terminal of the second inductor 633, the second terminal of the first capacitor 634 and the second end of the first through line 635, the second tuning circuit 640 is configured to tune the bandwidth of the intermediate frequency and/or the high frequency in non-carrier aggregation state and carrier aggregation state.

Figure 11:
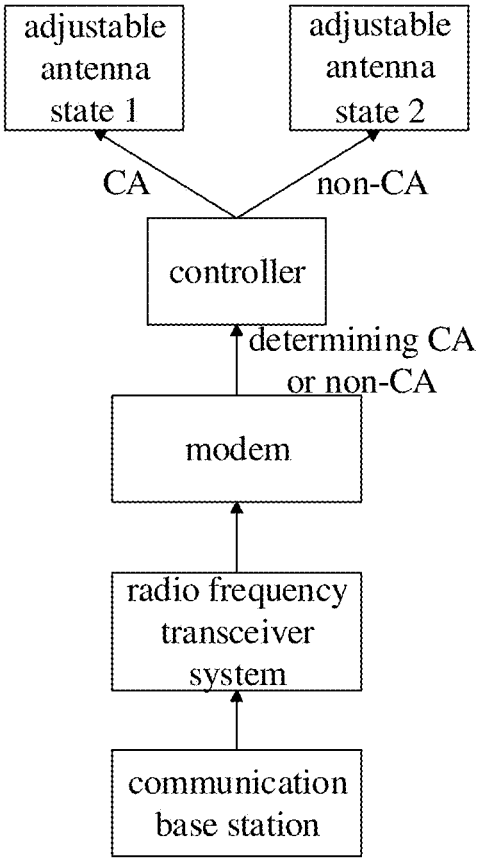
FIG. 11 is a schematic procedure diagram illustrating realization of CA state and non-CA state of the antenna.

It should be noted that, in order to improve an antenna performance of non-carrier aggregation, only the antenna has an adjustable ability, and state 1 has a good performance for carrier aggregation state, state 2 has a good performance for non-carrier aggregation state. For example, it is assumed that state 1 has a good performance for carrier aggregation of B39+B41, and state 2 has a good performance for non-carrier aggregation state of B39 or B41. Then a mobile terminal system automatically recognizes that the mobile terminal is in the carrier aggregation or the non-carrier aggregation state currently according to a base station signal, and then chooses a corresponding controller state to control the antenna in an optimal antenna state. A detailed implementation flow chart is shown in FIG. 11. In addition, this situation may also be applied to any band with the carrier aggregation and the non-carrier aggregation, such as a B5+B1+B3 carrier aggregation or a B1+B3 carrier aggregation.

In this case, the distance from the feed point 612 to the end 613 of the antenna unit is about 10 mm-30 mm.

Specifically, the second tuning circuit 640 includes: a second switch 641, a second capacitor 642 and a second through line 643; a first terminal of the second capacitor 642 is connected with a first end of the second through line 643 to form a second connection point, and the second connection point is connected with the antenna feed 620; a first terminal of the second switch 641 is connected with the feed point 612, and a second terminal of the second switch 641 is connected with a second terminal of the second capacitor 642 or a second end of the second through line 643; wherein, when the second terminal of the first switch 631 is connected with at least one of the second terminal of the first inductor 632, the second terminal of the second inductor 633, the second terminal of the first capacitor 634 and the second end of the first through line 635, and the second terminal of the second switch 641 is connected with the second end of the second through line 643, the antenna circuit operates in the non-carrier aggregation state.

It should be noted that, the second switch 641 is a single-pole multi-throw switch and the second capacitor 642 has a capacitance of 0.9 pf. When the second through line 643 is set, the non-carrier aggregation performance of B39 or B41 is achieved; when the second capacitor 642 is set, the carrier aggregation state of B39+B41 is achieved. That is to say, the carrier aggregation state and the non-carrier aggregation state are distinguished in the intermediate frequency and the high frequency.

Figure 12:
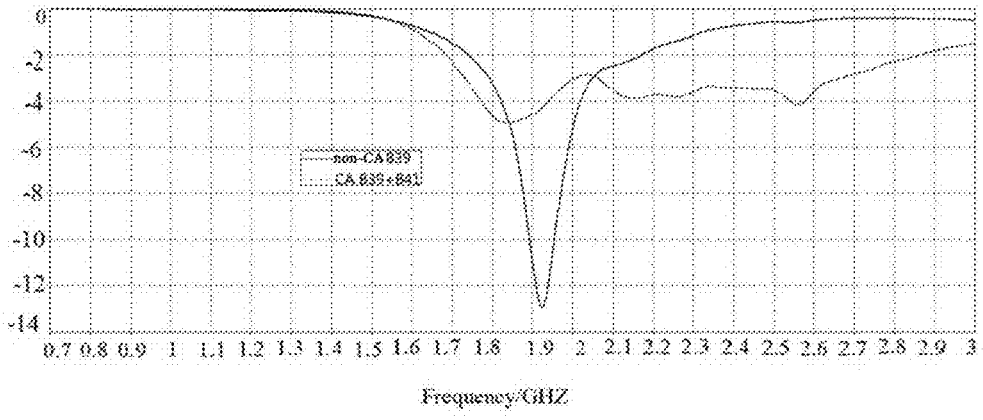
FIG. 12 is a comparison of antenna return losses between CA B39+B41 and non-CA B39.

As shown in FIG. 12, FIG. 12 is a comparison of antenna return losses between CA B39+B41 and non-CA B39, and obviously the return loss of B39 in the non-CA state is better.

It should be noted that, when the second terminal of the first switch 631 is not connected with any of the second terminal of the first inductor 632, the second terminal of the second inductor 633, the second terminal of the first capacitor 634 and the second end of the first through line 635, and the second terminal of the second switch 641 is connected with the second terminal of the second capacitor 642, a resonant mode in a low frequency band is generated.

Figure 13:
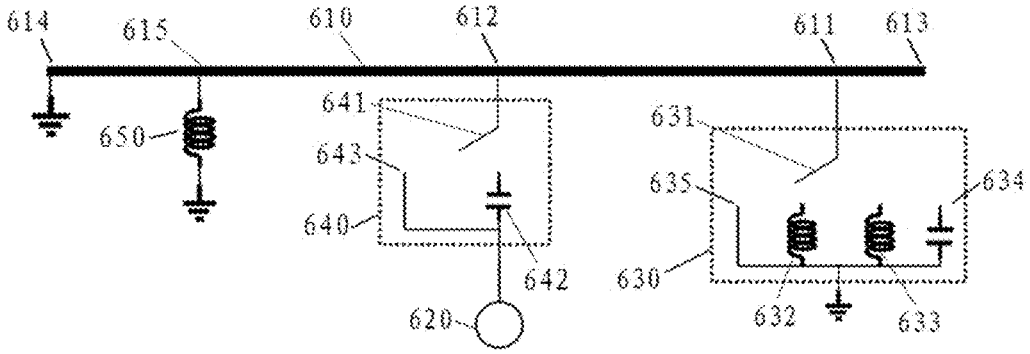
FIG. 13 is a schematic diagram illustrating a structure of an antenna circuit according to one embodiment of the present disclosure.

In order to further realize carrier aggregation of the intermediate frequency and the high frequency, as shown in FIG. 13, the antenna circuit further includes: a third inductor 650; a first terminal of the third inductor 650 is connected with the antenna unit 610, and a second terminal of the third inductor 650 is grounded; the second terminal of the second switch 641 is connected with the second terminal of the second capacitor 642, the antenna circuit operates in the carrier aggregation state, the third inductor 650 and the second capacitor 642 are configured to convert the single resonant mode into two resonant modes, realize the carrier aggregation of the intermediate frequency and the high frequency, and increase the antenna bandwidth.

In this case, the second capacitor 642 is added to the feed point 612, and the capacitance value is 0.5~2 pf (a typical value is 0.9 pf), which may expand the bandwidth because the original single resonant mode may be changed into two resonant modes. A distance from a connection point 615 of the third inductor 650 on the antenna unit 610 to the feed point 612 is 0 mm-8 mm, and a typical value is 3 mm. The third inductor 650 is added through the connection point 615. The third inductor 650 may adjust the resonant frequency of a first resonant mode to a B39 band. Generally, the third inductor 650 is 0 nH~25 nH, and a typical value is 6.8 nH. Then the switching circuit connection point 611 is connected with an inductor of 6.8 nH.

Figure 14:
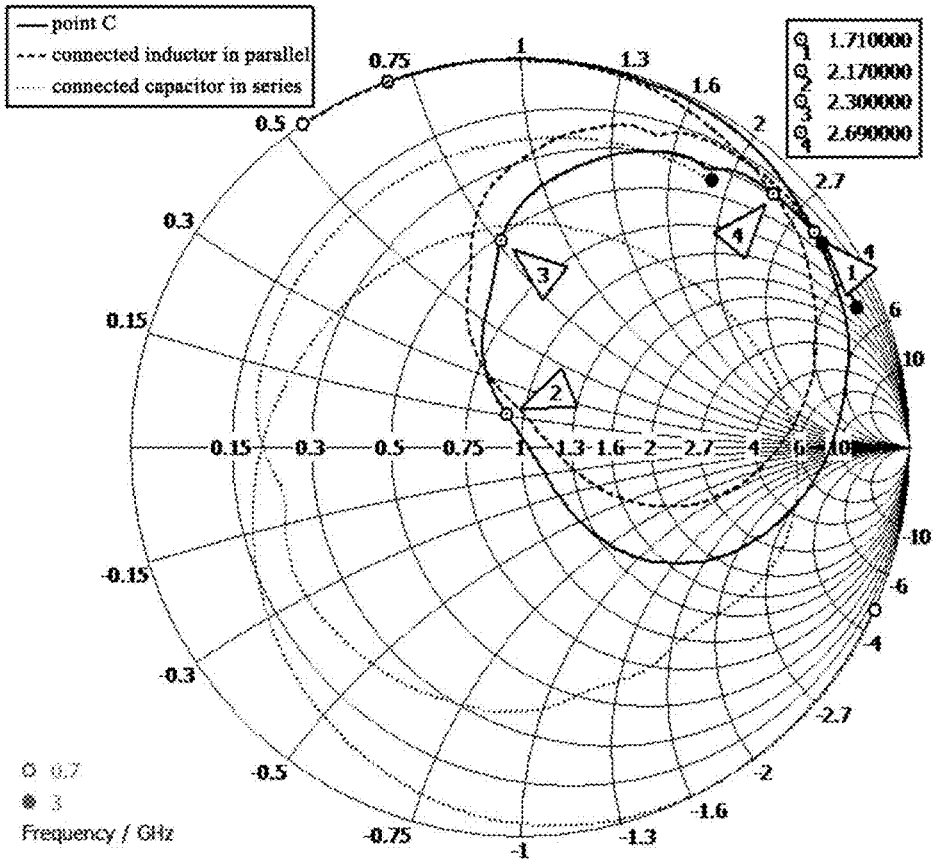
FIG. 14 is a schematic diagram illustrating a change procedure of an antenna impedance.
Figure 15:
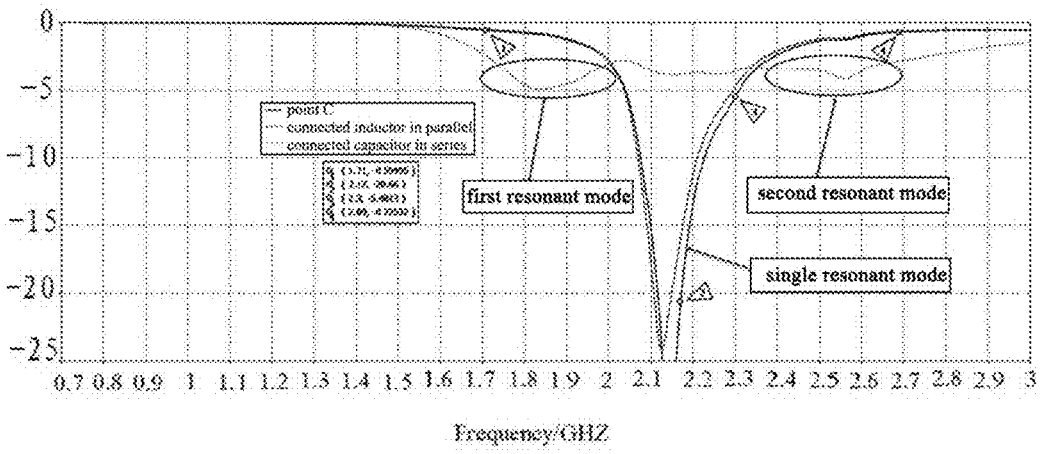
FIG. 15 is a schematic diagram illustrating a change procedure of return loss.

A change procedure of an antenna impedance is shown in FIG. 14, "point C" impedance represents an impedance without the third inductor 650 and the second capacitor 642, "connected inductor in parallel" impedance represents an impedance inclusive of the third inductor 650 but without the second capacitor 642, "connected capacitor in series" impedance represents an impedance inclusive of the third inductor 650 and the second capacitor 642. A change procedure of the return loss is shown in FIG. 15. It can be seen that, since the third inductor 650 and the second capacitor 642 are added, the original single resonant mode is changed into two resonant modes, a first one is to cover B39 and a second one is to cover B41.

Figure 16:
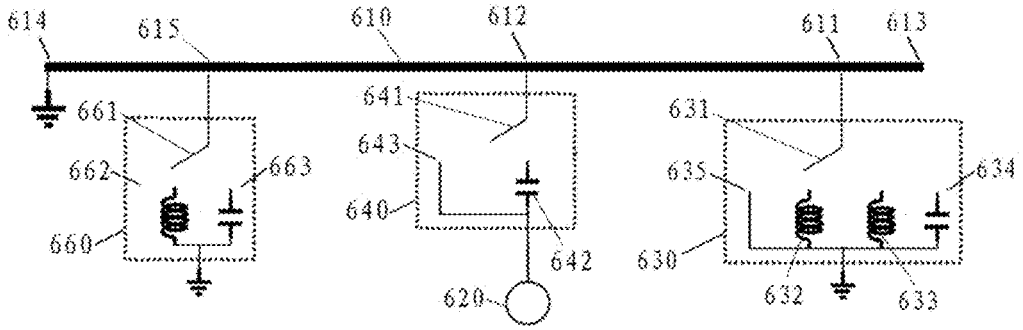
FIG. 16 is a schematic diagram illustrating a structure of an antenna circuit according to one embodiment of the present disclosure.

In order to realize carrier aggregation of the low-frequency and the intermediate-frequency, when the second terminal of the first switch 631 is not connected with any of the second terminal of the first inductor 632, the second terminal of the second inductor 633, the second terminal of the first capacitor 634 and the second end of the first through line 635, and the second terminal of the second switch 641 is connected with the second terminal of the second capacitor 642, as shown in FIG. 16, the antenna circuit of the embodiment of the present disclosure further includes: a third tuning circuit 660; a first terminal of the third tuning circuit 660 is connected with the antenna unit 610, or the first terminal of the third tuning circuit 660 is connected with the first terminal of the second capacitor 642 (the latter case is not shown in FIG. 16), and a second terminal of the third tuning circuit 660 is grounded; wherein the third tuning circuit 660 and the second capacitor 642 are configured to generate two resonance modes in the low frequency band and an intermediate frequency band.

Specifically, the third tuning circuit 660 includes: a third switch 661, a fourth inductor 662 and a third capacitor 663; wherein a first terminal of the third switch 661 is connected with the antenna unit 610, or the first terminal of the third switch 661 is connected with the first terminal of the second capacitor 642; a second terminal of the third switch 661 is connected to at least one of the first terminal of the fourth inductor 662 and the first terminal of the third capacitor 663; a second terminal of the fourth inductor 662 and the second terminal of the third capacitor 663 are connected to form a third connection point, and the third connection point is grounded.

In this case, the distance from the feed point 612 to the end 613 of the antenna unit is required to be 20 mm-30 mm, and a typical value is 23 mm. A purpose of such configuration is to make the intermediate frequency impedance of the feed point 612 enter an upper half of a smith diagram. The switching circuit connection point 611 may be connected or disconnected with the first tuning circuit 630, but it is required to be equivalent to an open circuit characteristic of low frequency band. The distance from the feed point 612 to the connection point 615 of the third tuning circuit 660 on the antenna unit 610 is 0 mm-8 mm, and a typical value is 3 mm. The third capacitor 663 is about 0~3 pf (a typical value is 1.2 pf), the fourth inductor 662 is about 12 nH~100 nH (a typical value is 18 nH), and the second capacitor 642 is about 0.5 pf~2 pf (a typical value is 0.9 pf). Two resonant modes, i.e., the low frequency and the intermediate frequency, may be generated to cover the antenna bandwidth required by the low-frequency and intermediate-frequency CA.

Figure 17:
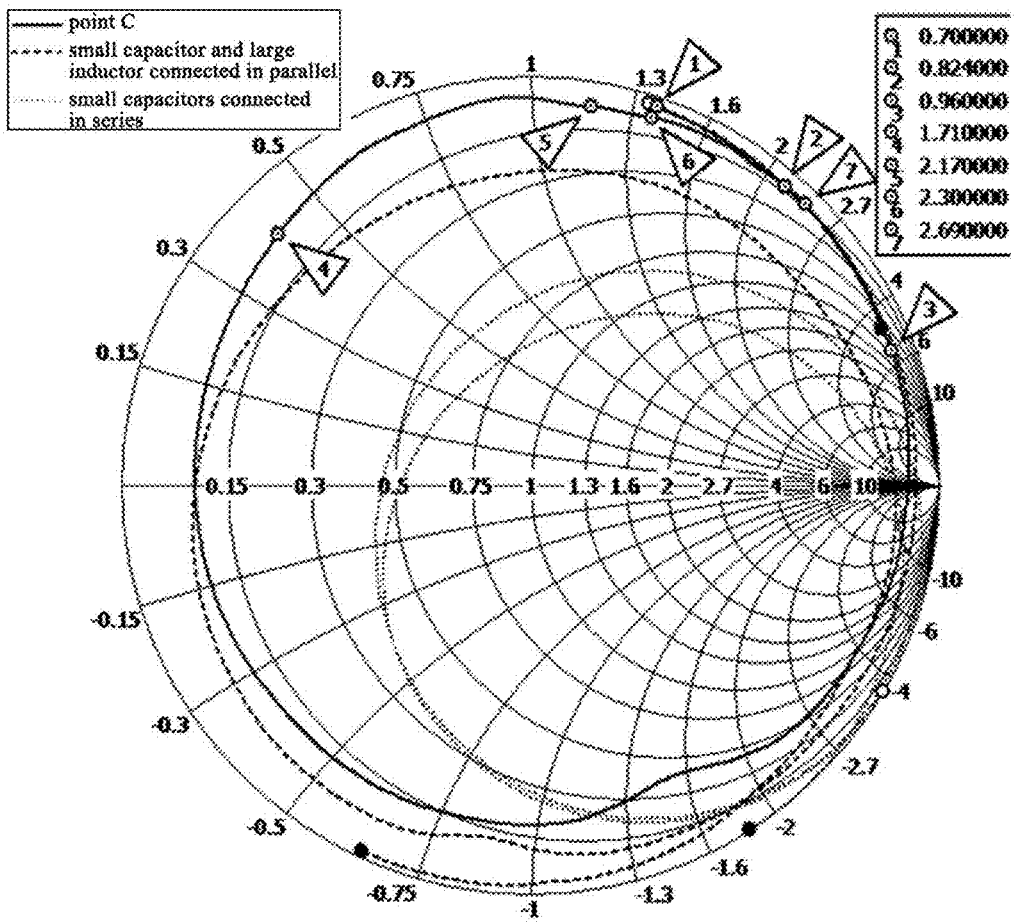
FIG. 17 is a schematic diagram illustrating a change procedure of an antenna impedance.
Figure 18:
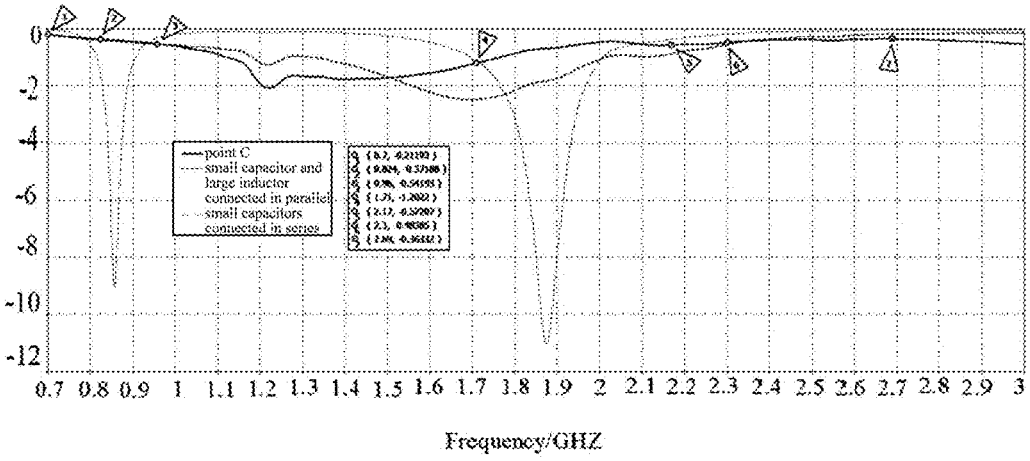
FIG. 18 is a schematic diagram illustrating a change procedure of return loss.

FIG. 17 is a schematic diagram illustrating a change procedure of antenna impedance, FIG. 18 is a schematic diagram illustrating a change procedure of return loss. As shown in FIG. 17 and FIG. 18, "point C" impedance shows an impedance curve without the second capacitor 642, the fourth inductor 662 and the third capacitor 663. "small capacitor and large inductor connected in parallel" represents an impedance curve inclusive of the fourth inductance 662 and the third capacitor 663, but without the second capacitor 642, and the "small capacitors connected in series" represents an impedance curve inclusive of the second capacitor 642, the fourth inductor 662 and the third capacitor 663. It can be seen that, two resonance modes for the low frequency and the intermediate frequency, are realized.

Figure 19:
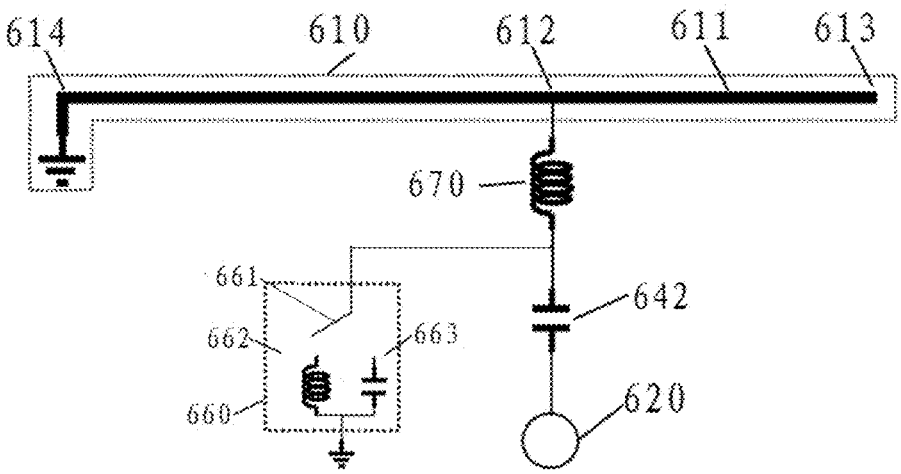
FIG. 19 is a schematic diagram illustrating a structure of an antenna circuit according to one embodiment of the present disclosure.

When the distance from the feed point 612 to the end 613 of the antenna unit ranges from 15 mm to 20 mm and a typical value is 15 mm, an intermediate-frequency impedance of the feed point 612 may still be in a lower half of the smith diagram. To solve this problem, as shown in FIG. 19, the antenna circuit further includes: a length adjusting inductor 670.

A first terminal of the length adjusting inductor 670 is connected with the feed point 612, and a second terminal of the length adjusting inductor 670 is connected with the first terminal of the second capacitor 642.

The intermediate frequency impedance may enter the upper half of the smith diagram by connecting the length adjusting inductor in series. The length adjusting inductor is usually 0 nH-12 nH, and a typical value is 6 nH (which may also be replaced by a transmission line with an equal inductance value).

Figure 20:
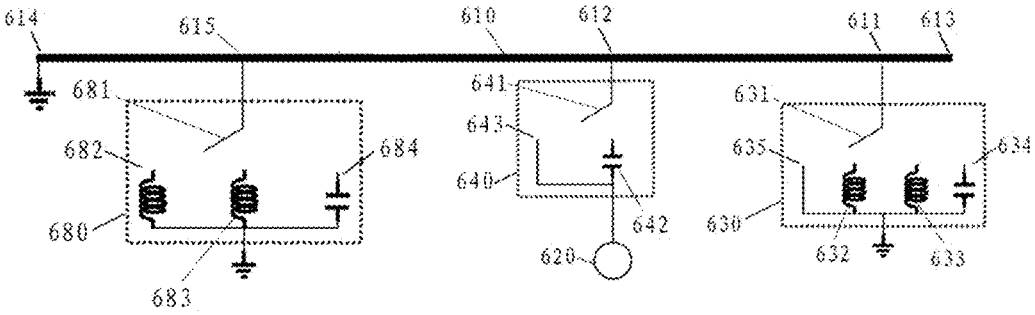
FIG. 20 is a schematic diagram illustrating a structure of an antenna circuit according to one embodiment of the present disclosure.

In order to realize the low-frequency and tune in the low-frequency, as shown in FIG. 20, the antenna circuit of the embodiment of the present disclosure further includes: a fourth tuning circuit 680, a first terminal of the fourth tuning circuit 680 is connected with the antenna unit 610, and a second terminal of the fourth tuning circuit 680 is grounded; wherein the fourth tuning circuit 680 and the second capacitor 642 are configured to realize the low frequency and tune in the low-frequency.

It should be noted that, in this case, the second terminal of the first switch 631 is not connected with any of the second terminal of the first inductor 632, the second terminal of the second inductor 633, the second terminal of the first capacitor 634 and the second end of the first through line 635, and the second terminal of the second switch 641 is connected with the second terminal of the second capacitor 642.

Specifically, the fourth tuning circuit 680 includes: a fourth switch 681, a fifth inductor 682, a sixth inductor 683 and a fourth capacitor 684; wherein a first terminal of the fifth inductor 682, a first terminal of the sixth inductor 683 and a first terminal of the fourth capacitor 684 are connected at a fifth connection point, and the fifth connection point is grounded; a first terminal of the fourth switch 681 is connected with the antenna unit 610, and a second terminal of the fourth switch 681 is connected with at least one of a second terminal of the fifth inductor 682, a second terminal of the sixth inductor 683 and a second terminal of the fourth capacitor 684.

It should be noted that, in order to realize the low frequency, a second capacitor 642 with a capacitance value of 0.5 pf-2 pf (a typical value of 0.9 pf) is required. In order to cover a wider bandwidth in the low frequency, the fourth tuning circuit 680 may have multiple branches, and may switch different branches to tune the low frequency. The fourth switch 681 is a single-pole multi-throw switch, the fifth inductor 682 is 18 nH, the sixth inductor 683 is 15 nH, and the fourth capacitor 684 is 1.2 pf. Only the fourth capacitor 684 operates in B12, only the fourth capacitor 684 and the fifth inductance 682 operate in the carrier aggregation state of B5+B1+B3 at the same time, and only the sixth inductor 683 operates in B8.

Figure 21:
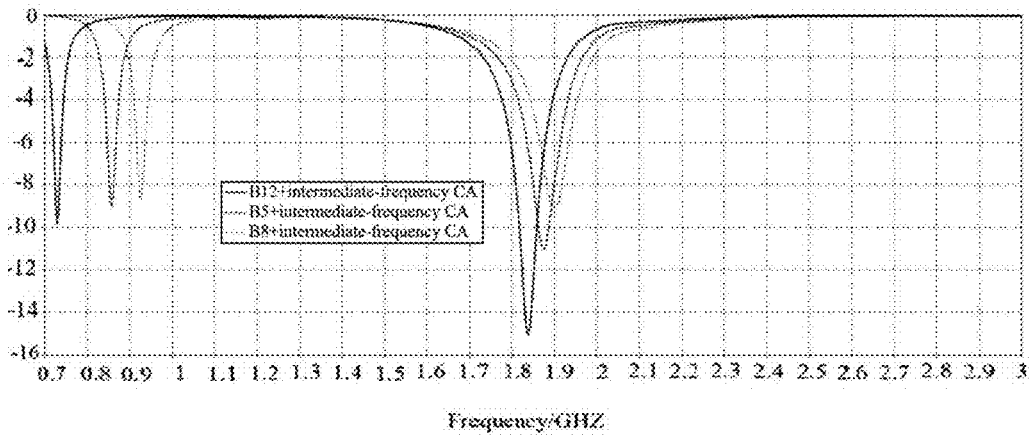
FIG. 21 is a schematic tuning diagram of a fourth tuning circuit for a low-frequency in a "low-frequency+intermediate-frequency" CA state.
Figure 22:
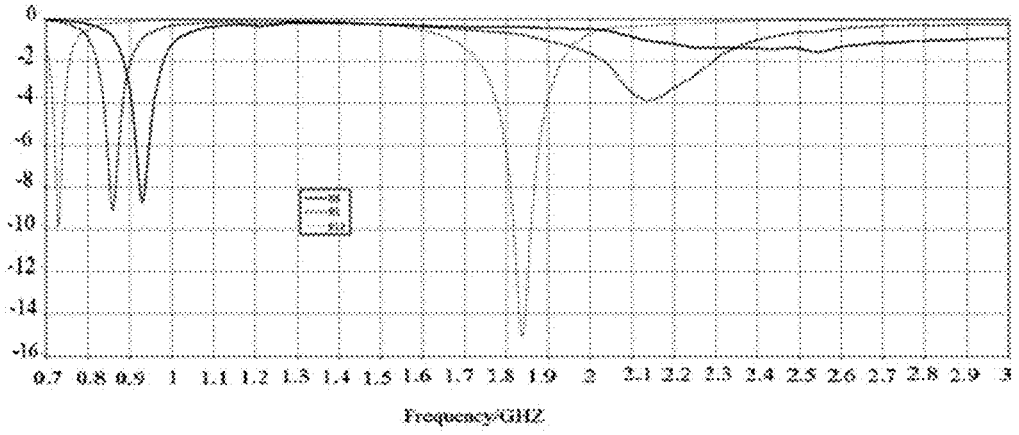
FIG. 22 is a schematic tuning diagram of a fourth tuning circuit for a low-frequency in a low-frequency non-CA state.

In a "low-frequency+intermediate-frequency" CA state (e.g. B5+B1+B3, B12+B1+B3), a schematic tuning diagram of a fourth tuning circuit 680 for a low-frequency is shown in FIG. 21; in a low-frequency non-CA state (e.g. B12/B5/B8), a schematic tuning diagram of a fourth tuning circuit 680 for a low-frequency is shown in FIG. 22.

It should be noted that, when the antenna circuit includes the third tuning circuit, the third tuning circuit and the fourth tuning circuit are connected with a same location or different locations of the antenna unit;

when the third tuning circuit and the fourth tuning circuit are connected with the same location of the antenna unit, the third tuning circuit and the fourth tuning circuit are combined to form a first combined coordination circuit, the first combined coordination circuit includes:

a first combined switch, a first combined inductor, a second combined inductor and a first combined capacitor; a first terminal of the first combined inductor, a first terminal of the second combined inductor and a first terminal of the first combined capacitor are connected at a first combined connection point, and the first combined connection point is grounded; a first terminal of the first combined switch is connected with the antenna unit, a second terminal of the first combined switch is connected with at least one of a second terminal of the first combined inductor, a second terminal of the second combined inductor and a second terminal of the first combined capacitor; when the second terminal of the first combined switch is connected with the second terminal of the first combined capacitor, the first combined capacitor and the second capacitor are configured to generate two resonance modes in the low frequency band and the intermediate frequency band; the first combined inductor and the second combined inductor are configured to tune the resonance frequency in the low frequency band.

Figure 23:
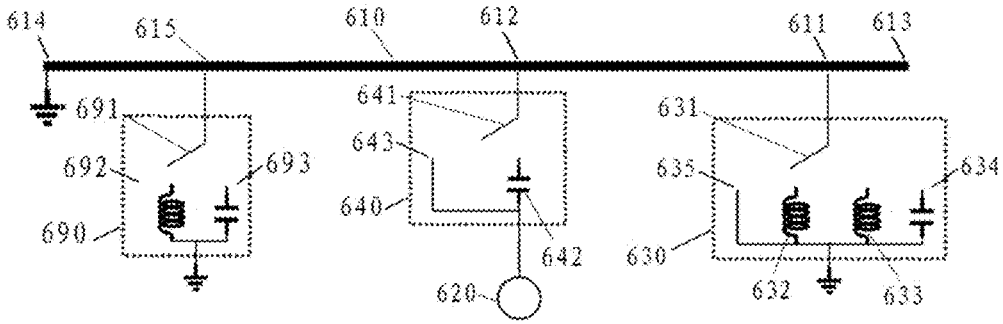
FIG. 23 is a schematic diagram illustrating a structure of an antenna circuit according to one embodiment of the present disclosure.

In order to further expand a tuning range of the intermediate-high frequency, as shown in FIG. 23, the antenna circuit of the embodiment of the present disclosure further includes: a fifth tuning circuit 690; wherein a first terminal of the fifth tuning circuit 690 is connected with the antenna unit 610, and a second terminal of the fifth tuning circuit 690 is grounded; the fifth tuning circuit 690 is configured to increase the tuning range of the intermediate-high frequency.

Specifically, the fifth tuning circuit 690 further includes: a fifth switch 691, a seventh inductor 692 and a fifth capacitor 693; wherein a first terminal of the seventh inductor 692 is connected with a first terminal of the fifth capacitor 693 to form a sixth connection point, and the sixth connection point is grounded; a first terminal of the fifth switch 691 is connected with the antenna unit, and a second terminal of the fifth switch 691 is connected with at least one of a second terminal of the seventh inductor 692 and a second terminal of the fifth capacitor 693.

In this case, the second terminal of the first switch 631 is connected with at least one of the second terminal of the first inductor 632, the second terminal of the second inductor 633, the second terminal of the first capacitor 634 and the second end of the first through line 635, the second terminal of the second switch 641 is connected to the second through line 643.

The fifth tuning circuit 690 may be realized by using the third tuning circuit 660.

It should also be noted that, when the antenna circuit includes the third inductor, the third inductor and the fifth tuning circuit are connected with a same location or different locations of the antenna unit; wherein, when the third inductor and the fifth tuning circuit are connected with the same location of the antenna unit, the third inductor and the fifth tuning circuit are combined to form a second combined coordination circuit, the second combined coordination circuit includes: a second combined switch, a third combined inductor, a fourth combined inductor and a second combined capacitor; a first terminal of the third combined inductor, a first terminal of the fourth combined inductor and a first terminal of the second combined capacitor are connected at a second combined connection point, and the second combined connection point is grounded; a first terminal of the second combined switch is connected with the antenna unit, a second terminal of the second combined switch is connected with at least one of a second terminal of the third combined inductor, a second terminal of the fourth combined inductor and a second terminal of the second combined capacitor.

Figure 24:
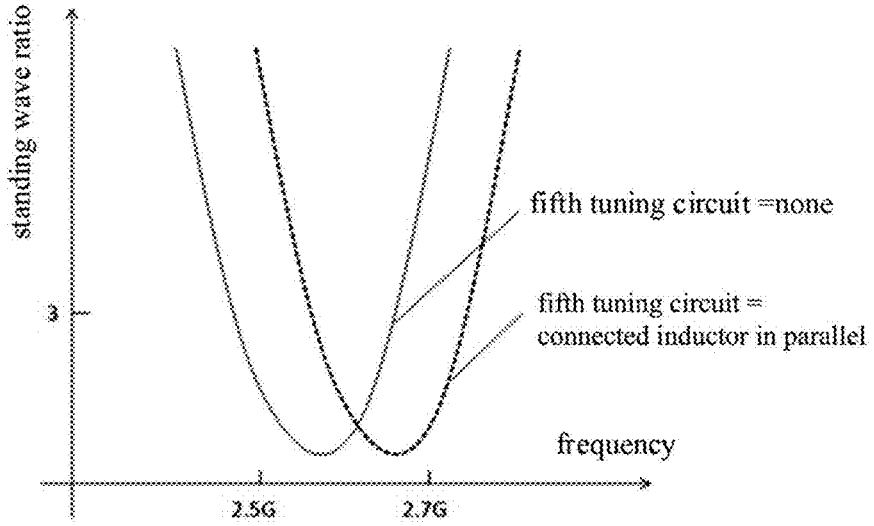
FIG. 24 is a schematic tuning diagram of a fifth tuning circuit for a high-frequency resonant mode.

As shown in FIG. 24, the switching circuit connection point 611 is connected with a capacitor of 8.2 pf, and the fifth tuning circuit 690 is set to be connected with an inductor of 3.9 nH, which may make the high frequency resonance mode move to a higher frequency. On the contrary, if the fifth tuning circuit 690 is set to be connected with a capacitor in parallel, the high frequency resonance mode may move to a lower frequency.

It should be noted that, each function implemented by the antenna circuit described in the present disclosure may be combined to realize the function of the antenna.

Figure 25:
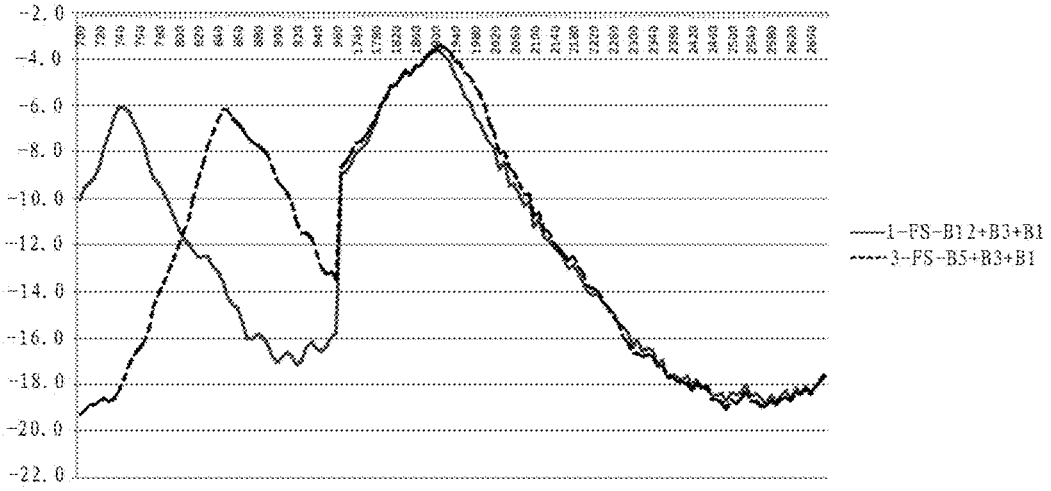
FIG. 25 is a schematic diagram illustrating antenna efficiencies in a free space of low-frequency+intermediate-frequency CAs.

FIG. 25 shows antenna efficiencies in a free space of the low-frequency+intermediate-frequency CA, "1-FS-B12+B3+B1" in FIG. 25 indicates the antenna efficiency in the CA state of B12+B3+B1. At this time, the third tuning circuit 660 is set to be 1.2 pf, the second tuning circuit 640 is set to be 0.9 pf, the first tuning circuit 630 is set to be an open circuit, and "3-FS-B5+B3+B1" indicates the antenna efficiency in the CA state of B5+B3+B1. At this time, the third tuning circuit 660 is set to be a parallel circuit of 1.2 pf+18 nH, the second tuning circuit 640 is set to be 0.9 pf, and the first tuning circuit 630 is set to be an open circuit. In addition, B8+B3+B1 may also be realized. At this time, only the third tuning circuit 660 is set to be a parallel circuit of 1.2 pf+15 nH, the second tuning circuit 640 is set to be 0.9 pf, the first tuning circuit 630 is set to be an open circuit, and the length adjusting inductor is 3 nH.

Figure 26:
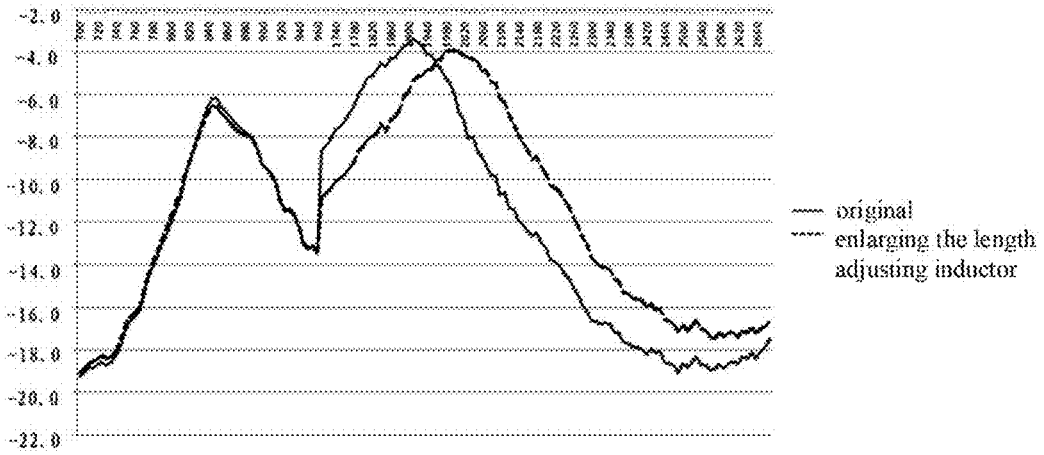
FIG. 26 is a schematic diagram showing a change in resonance frequency of an intermediate-frequency when adjusting a length adjusting inductor.

FIG. 26 shows an effect of adjusting the length adjusting inductor. The resonance frequency of intermediate frequency may be adjusted effectively. In FIG. 26, "original" indicates the antenna efficiency without the length adjusting inductor in the CA state of B5+B1+B3, and "enlarging the length adjusting inductor" indicates the antenna efficiency having a length adjusting inductor of 6 nH in the CA state of B5+B1+B3.

Figure 27:
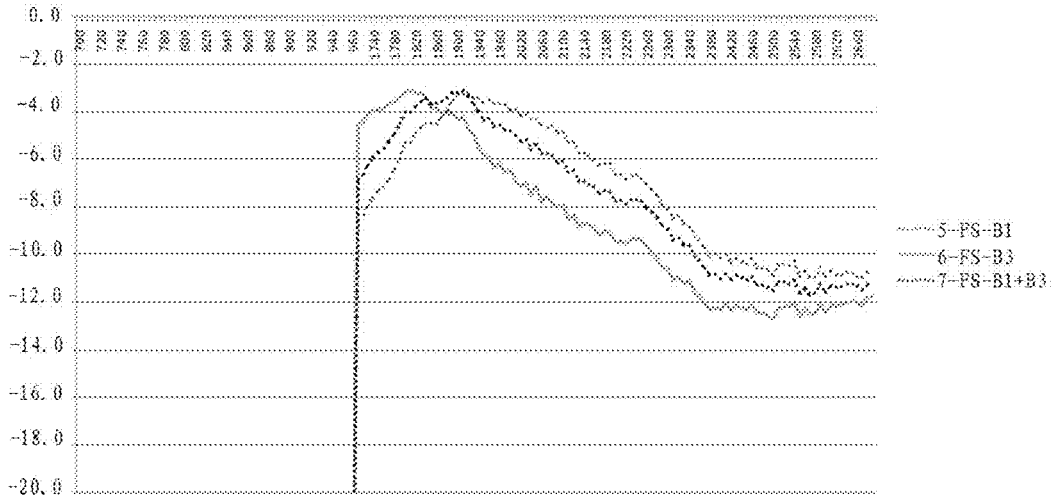
FIG. 27 is a schematic diagram illustrating differences of antenna efficiencies between non-CA and CA states of B1 and B3.

FIG. 27 shows differences of the antenna efficiencies between non-CA and CA states of B1 and B3. "5-FS-B1", "6-FS-B3" and "7-FS-B1+B3" indicate the antenna efficiency of B1 in the non-CA state, B3 in the non-CA state and B1+B3 in the CA state respectively. At this time, the third tuning circuit 660 is set to be 6.8 nH, the second tuning circuit 640 is set to be straight-through, and the first tuning circuit 630 is set to be 6.8 nH (corresponding to B3), 4.7 nH (corresponding to B1+B3), and 3.9 nH (corresponding to B1) respectively.

Figure 28:
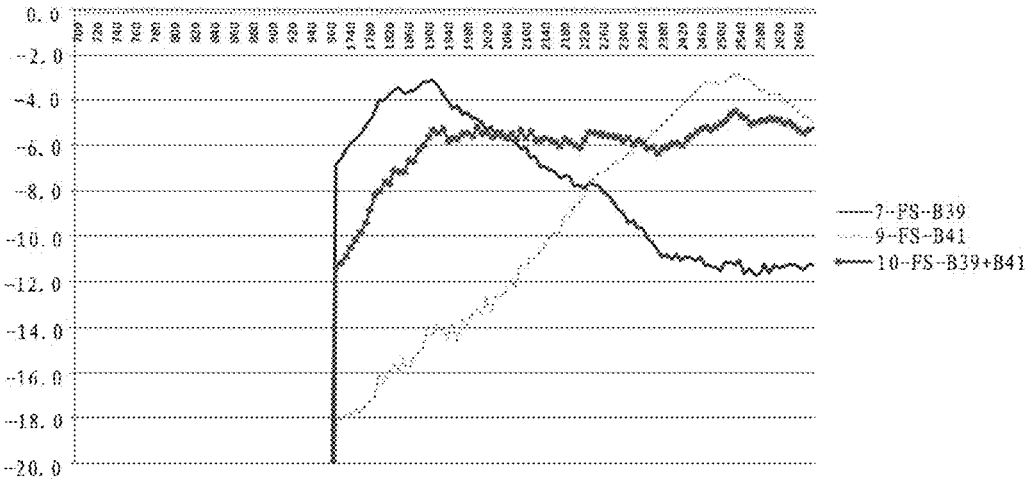
FIG. 28 is a schematic diagram illustrating differences of antenna efficiencies between non-CA and CA states of B39 and B41.

FIG. 28 shows differences of the antenna efficiencies between non-CA and CA states of B39 and B41. "7-FS-B39", "9-FS-B41" and "10-FS-B39+B41" indicate the antenna efficiency of B39 in the non-CA state, B41 in the non-CA state and B39+B41 in the CA state, respectively. It can be seen that, the efficiency of B39 in the non-CA state is about 1 dB-2 dB larger than that of B39 in the CA state, and the efficiency of B41 in the non-CA state is about 1-2 dB larger than that of B41 in the CA state. In CA B39+B41, the third tuning circuit 660 is set to be 6.8 nH, the second tuning circuit 640 is set to be 0.9 pf, and the first tuning circuit 630 is set to be 6.8 nH; in the non-CA state, the third tuning circuit 660 is set to be 6.8 nH, the second tuning circuit 640 is set to be straight-through, and the first tuning circuit 630 is set to be 6.8 nH (corresponding to B39), 8.2 pf (corresponding to B41), and the length adjusting is 3 nH respectively.

Figure 29:
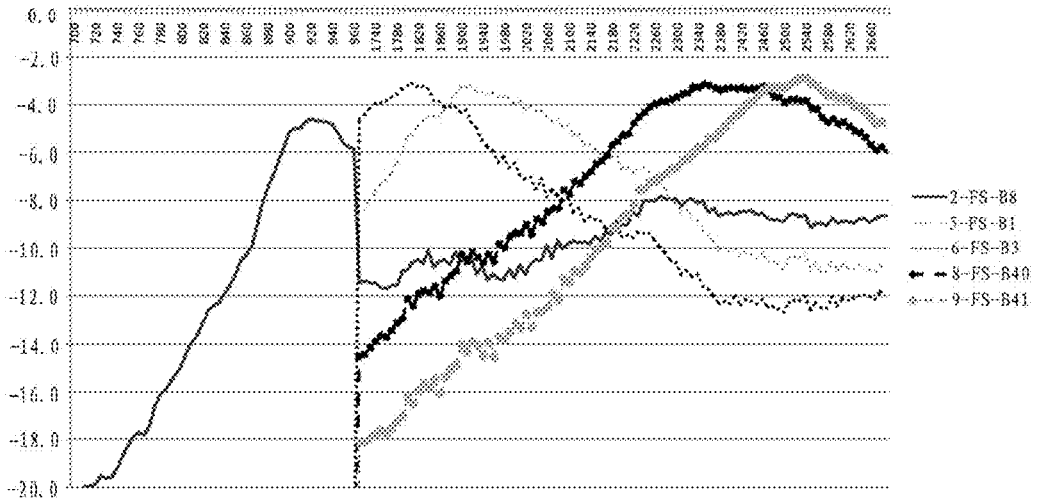
FIG. 29 is a schematic diagram illustrating antenna efficiencies in a free space of B8/B1/B3/B40/B41 in a non-CA state.

FIG. 29 shows the antenna efficiencies in a free space of B8/B1/B3/B40/B41 in the non-CA state. "2-FS-B8", "5-FS-B1", "6-FS-B3", "8-FS-B40" and "9-FS-B41" respectively indicate the antenna efficiency of non-CA B8, B1, B3, B40 and B41. In B8, the third tuning circuit 660 is set to be 15 nH, the second tuning circuit 640 is set to be 0.9 pf, and the first tuning circuit 630 is set to be open, and the length adjusting inductor is equal to 3 nH. When in B1/B3/B40/B41, the third tuning circuit 660 is set to be 6.8 nH, the second tuning circuit 640 is set to be straight-through, and the first tuning circuit 630 is set to be 6.8 nH (corresponding to B3), 3.9 nH (corresponding to B1), 0 ohm (corresponding to B40), 8.2 pf (corresponding to B41), respectively. The length adjusting inductor is equal to 3 nH.

The above embodiments of the present disclosure may improve the bandwidth of the single resonant mode in the intermediate frequency and the high frequency effectively, expand the bandwidth in the intermediate frequency and the high frequency, realize the low frequency and expand the bandwidth in the low frequency, and improve the performance of the antenna as a whole.

An embodiment of the present disclosure further provides a mobile terminal, including the antenna circuit described above.

It should be noted that, the mobile terminal equipped with the antenna circuit improves a communication performance of the mobile terminal and a user's experience.

Figure 30:
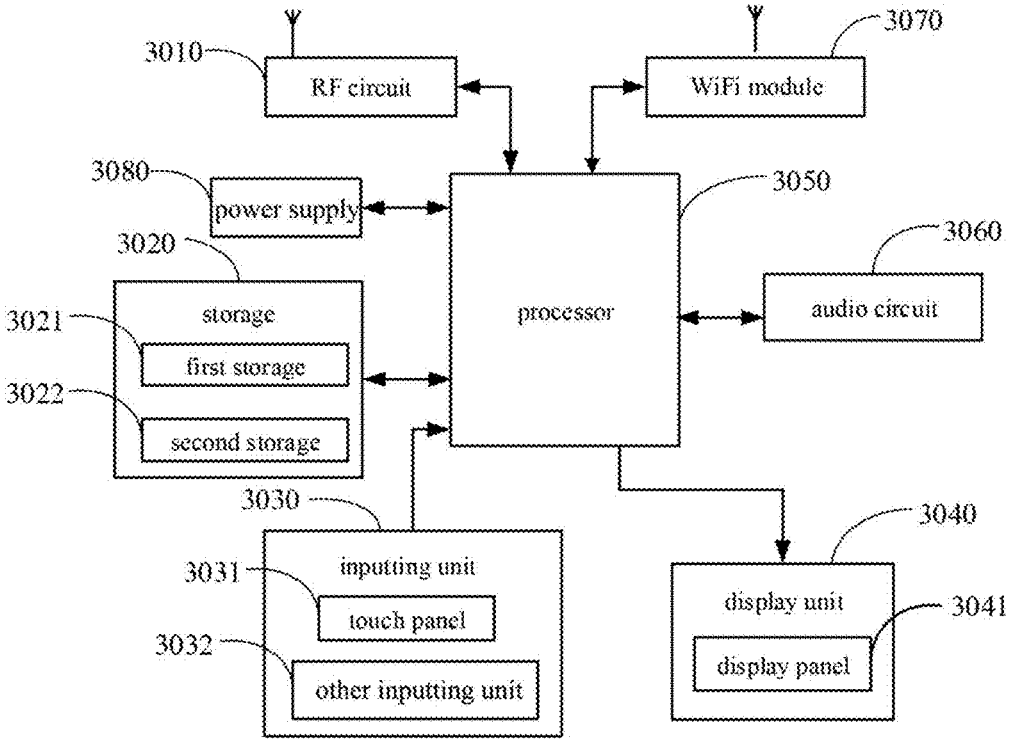
FIG. 30 is a schematic diagram illustrating a structure of a mobile terminal according to embodiments of the present disclosure.

FIG. 30 is a schematic diagram illustrating a structure of a mobile terminal according to embodiments of the present disclosure. Specifically, the mobile terminal in FIG. 30 may be a mobile phone, a tablet computer, a personal digital assistant (PDA) and a vehicle computer.

The mobile terminal in FIG. 30 includes a Radio Frequency (RF) circuit 3010, a storage 3020, an inputting unit 3030, a display unit 3040, a processor 3050, an audio circuit 3060, a WiFi module 3070 and a power supply 3080.

The inputting unit 3030 may receive inputted numeral or character information, and generate signal input related with user configuration and function control of the mobile terminal. Specifically, in the embodiments of the present disclosure, the inputting unit 3030 may include a touch panel 3031. The touch panel 3031 is also called a touch screen, and may collect a touch operation performed by a user on or near the touch panel 3031 (e.g., the user performs an operation on or near the touch panel 3031 with any suitable object or accessory such as a finger and a touch pen), and drive a connection device according to a preset program. Optionally, the touch panel 3031 may include a touch detecting device and a touch controller. The touch detecting device may detect a touch position of the user, detect a signal generated based on the touch operation, and transmit the signal to the touch controller. The touch controller may receive touch information from the touch detecting device, convert the touch information into a touch point coordinate, transmit the touch point coordinate to the processor 3050, and receive and execute a command sent by the processor 3050. In addition, the touch panel 3031 may be implemented by multiple modes such as a resistive mode, a capacitive mode, an infrared mode or a surface acoustic wave mode. Besides the touch panel 3031, the inputting unit 3030 may further include another inputting device 3032. The inputting device 3032 may include, but is not limited to, at least one of a physical keyboard, a function key (such as a volume control key, a switch key etc.), a trackball, a mouse and an operating lever.

The display unit 3040 may display information inputted by the user or information provided to the user and various menu interfaces of the mobile terminal. The display unit 3040 may include a display panel 3041, which may be configured by a Liquid Crystal Display (LCD) and an Organic Light-Emitting Diode (OLED).

It should be noted that the touch panel 3031 may cover the display panel 3041 to form a touch display screen. When a touch operation on or near the touch display screen is detected, and transmitted to the processor 3050 to determine a type of a touch event. The processor 3050 then provides a corresponding visual output on the touch display screen according to the type of the touch event.

The touch display screen includes an application interface display region and a common controls display region. The application interface display region and the common controls display region may be arranged in an unrestricted manner, such as an upper and lower alignment, a left and right alignment, or other alignments distinguishing the two display regions. The application interface display region may display an interface of the application. Each interface may include at least one application icon and/or interface elements such as a Widget desktop control. The application interface display region may also be an empty interface without any content. The common controls display region may display a control with a high usage rate, such as a setting button, an interface number, a scroll bar, a telephone icon and other application icons.

The processor 3050 is a control center of the mobile terminal. The processor 3050 connects all parts of a mobile phone by various interfaces and lines. The processor 3050 performs various functions and processes of the mobile terminal by running or executing software programs and/or modules stored in a first storage 3021 and calling data stored in a second storage 3022, so as to monitor the mobile terminal as a whole. Optionally, the processor 3050 may include one or more processing units.

It should be noted that the Radio Frequency (RF) circuit 3010 includes: an antenna unit, a switching circuit connection point and a feed point is arranged on the antenna unit, an antenna feed is connected with the feed point, a first tuning circuit is connected with the switching circuit connection point, the first tuning circuit is configured to increase a bandwidth of a single resonant mode in an intermediate-high frequency and/or to tune a resonant frequency in the intermediate-high frequency; wherein a distance from the feed point to the end of the antenna unit is larger than a distance from the switching circuit connection point to the end of the antenna unit.

Specifically, the first tuning circuit includes: a first switch, a first inductor, a second inductor, a first capacitor and a first through line; wherein a first terminal of the first inductor, a first terminal of the second inductor, a first terminal of the first capacitor and a first end of the first through line are connected at a first connection point, and the first connection point is grounded; a first terminal of the first switch is connected with the switching circuit connection point, a second terminal of the first switch is connected with at least one of a second terminal of the first inductor, a second terminal of the second inductor, a second terminal of the first capacitor and a second end of the first through line, or the second terminal of the first switch is not connected with any of the second terminal of the first inductor, the second terminal of the second inductor, the second terminal of the first capacitor and the second end of the first through line; when the second terminal of the first switch is connected with at least one of the second terminal of the first inductor, the second terminal of the second inductor, the second terminal of the first capacitor and the second end of the first through line, the bandwidth of the single resonant mode in the intermediate-high frequency is increased; when the second terminal of the first switch is connected with another one or more of the second terminal of the first inductor, the second terminal of the second inductor, the second terminal of the first capacitor and the second end of the first through line, the resonant frequency in the intermediate-high frequency is tuned.

In some optional embodiments, the Radio Frequency (RF) circuit 3010 further includes: a second tuning circuit, a first terminal of the second tuning circuit is connected with the feed point, and a second terminal of the second tuning circuit is connected with the antenna feed; when the second terminal of the first switch is connected with at least one of the second terminal of the first inductor, the second terminal of the second inductor, the second terminal of the first capacitor and the second end of the first through line, the second tuning circuit is configured to tune the bandwidth of the intermediate frequency and/or the high frequency in non-carrier aggregation state and carrier aggregation state.

Specifically, the second tuning circuit includes: a second switch, a second capacitor and a second through line, a first terminal of the second capacitor is connected with a first end of the second through line to form a second connection point, and the second connection point is connected with the antenna feed; a first terminal of the second switch is connected with the feed point, and a second terminal of the second switch is connected with a second terminal of the second capacitor or a second end of the second through line; wherein, when the second terminal of the first switch is connected with at least one of the second terminal of the first inductor, the second terminal of the second inductor, the second terminal of the first capacitor and the second end of the first through line, and the second terminal of the second switch is connected with the second end of the second through line, the antenna circuit operates in the non-carrier aggregation state.

Specifically, when the second terminal of the first switch is not connected with any of the second terminal of the first inductor, the second terminal of the second inductor, the second terminal of the first capacitor and the second end of the first through line, and the second terminal of the second switch is connected with the second terminal of the second capacitor, a resonant mode in a low frequency band is generated.

In some optional embodiments, when the second terminal of the first switch is connected with at least one of the second terminal of the first inductor, the second terminal of the second inductor, the second terminal of the first capacitor and the second end of the first through line, the Radio Frequency (RF) circuit 3010 further includes: a third inductor; wherein a first terminal of the third inductor is connected with the antenna unit, and a second terminal of the third inductor is grounded; the second terminal of the second switch is connected with the second terminal of the second capacitor, the antenna circuit operates in the carrier aggregation state, the third inductor and the second capacitor are configured to convert the single resonant mode into two resonant modes.

In some optional embodiments, the Radio Frequency (RF) circuit 3010 further includes: a third tuning circuit, a first terminal of the third tuning circuit is connected with the antenna unit, or the first terminal of the third tuning circuit is connected with the first terminal of the second capacitor, and a second terminal of the third tuning circuit is grounded; wherein the third tuning circuit and the second capacitor are configured to generate two resonance modes in the low-band and an intermediate frequency band.

Specifically, the third tuning circuit includes: a third switch, a fourth inductor and a third capacitor; wherein a first terminal of the third switch is connected with the antenna unit, or the first terminal of the third switch is connected with the first terminal of the second capacitor; a second terminal of the third switch is connected to at least one of the first terminal of the fourth inductor and the first terminal of the third capacitor; a second terminal of the fourth inductor and the second terminal of the third capacitor are connected to form a third connection point, and the third connection point is grounded.

In some optional embodiments, the Radio Frequency (RF) circuit 3010 further includes: a length adjusting inductor; wherein a first terminal of the length adjusting inductor is connected with the feed point, and a second terminal of the length adjusting inductor is connected with the first terminal of the second capacitor.

In some optional embodiments, the Radio Frequency (RF) circuit 3010 further includes: a fourth tuning circuit, a first terminal of the fourth tuning circuit is connected with the antenna unit, and a second terminal of the fourth tuning circuit is grounded; wherein the fourth tuning circuit and the second capacitor are configured to realize the low frequency and tune in the low-frequency.

Specifically, the fourth tuning circuit includes: a fourth switch, a fifth inductor, a sixth inductor and a fourth capacitor; wherein a first terminal of the fifth inductor, a first terminal of the sixth inductor and a first terminal of the fourth capacitor are connected at a fifth connection point, and the fifth connection point is grounded;

a first terminal of the fourth switch is connected with the antenna unit, and a second terminal of the fourth switch is connected with at least one of a second terminal of the fifth inductor, a second terminal of the sixth inductor and a second terminal of the fourth capacitor.

In some optional embodiments, when the antenna circuit includes the third tuning circuit, the third tuning circuit and the fourth tuning circuit are connected with a same location or different locations of the antenna unit; wherein, when the third tuning circuit and the fourth tuning circuit are connected with the same location of the antenna unit, the third tuning circuit and the fourth tuning circuit are combined to form a first combined coordination circuit, the first combined coordination circuit includes: a first combined switch, a first combined inductor, a second combined inductor and a first combined capacitor; a first terminal of the first combined inductor, a first terminal of the second combined inductor and a first terminal of the first combined capacitor are connected at a first combined connection point, and the first combined connection point is grounded; a first terminal of the first combined switch is connected with the antenna unit, a second terminal of the first combined switch is connected with at least one of a second terminal of the first combined inductor, a second terminal of the second combined inductor and a second terminal of the first combined capacitor; when the second terminal of the first combined switch is connected with the second terminal of the first combined capacitor, the first combined capacitor and the second capacitor are configured to generate two resonance modes in the low frequency band and the intermediate frequency band; the first combined inductor and the second combined inductor are configured to tune the resonance frequency in the low frequency band.

In some optional embodiments, when the second terminal of the first switch is connected with at least one of the second terminal of the first inductor, the second terminal of the second inductor, the second terminal of the first capacitor and the second end of the first through line, the Radio Frequency (RF) circuit 3010 further includes: a fifth tuning circuit; wherein a first terminal of the fifth tuning circuit is connected with the antenna unit, and a second terminal of the fifth tuning circuit is grounded; the fifth tuning circuit is configured to increase a tuning range of the intermediate-high frequency.

Specifically, the fifth tuning circuit includes: a fifth switch, a seventh inductor and a fifth capacitor; wherein a first terminal of the seventh inductor is connected with a first terminal of the fifth capacitor to form a sixth connection point, and the sixth connection point is grounded; a first terminal of the fifth switch is connected with the antenna unit, and a second terminal of the fifth switch is connected with at least one of a second terminal of the seventh inductor and a second terminal of the fifth capacitor.

In some optional embodiments, when the antenna circuit includes the third inductor, the third inductor and the fifth tuning circuit are connected with a same location or different locations of the antenna unit; wherein, when the third inductor and the fifth tuning circuit are connected with the same location of the antenna unit, the third inductor and the fifth tuning circuit are combined to form a second combined coordination circuit, the second combined coordination circuit includes: a second combined switch, a third combined inductor, a fourth combined inductor and a second combined capacitor; a first terminal of the third combined inductor, a first terminal of the fourth combined inductor and a first terminal of the second combined capacitor are connected at a second combined connection point, and the second combined connection point is grounded; a first terminal of the second combined switch is connected with the antenna unit, a second terminal of the second combined switch is connected with at least one of a second terminal of the third combined inductor, a second terminal of the fourth combined inductor and a second terminal of the second combined capacitor.

Specifically, the distance from the feed point to the end of the antenna unit is 15 mm to 30 mm, and the distance from the switching circuit connection point to the end of the antenna unit is 5 mm to 18 mm.

In the mobile terminal of the embodiment of the present disclosure, the feed point is set closer to a grounding end of the antenna unit by switching positions of the switching circuit connection point and the feed point of the antenna unit, thereby solving the problem that the bandwidth of the antenna in the intermediate frequency or the high frequency is insufficient. The bandwidth in the intermediate frequency and the high frequency is expanded, the low frequency is realized and the bandwidth in the low frequency is expanded, and the performance of the antenna is improved as a whole. Then the communication performance of the mobile terminal and the user's experience are improved.

Each embodiment of the specification is described in a progressive manner. Each embodiment focuses on differences from other embodiments, and same and similar parts among the embodiments may refer to each other.

It should be understood by those skilled in the art that the embodiments of the present disclosure may be provided as methods, devices, or computer program products. Therefore, the embodiments of the present disclosure may be embodiments with only hardware, embodiments with only software, or embodiments combined with software and hardware. Furthermore, one or more of the embodiments of the present disclosure may be computer program products implemented on computer readable storage media (including but not limited to a disk storage, a CD-ROM, an optical storage, etc.) including computer readable program code.

The embodiments of the present disclosure is described with reference to flow charts and/or block diagrams of a method, a terminal device (system), and a computer program product according to the embodiments of the present disclosure. It should be understood that each flow and/or each block in a flowchart and/or a block diagram, and a combination of the flow and/or the block in the flowchart and/or the block diagram, may be implemented by computer program instructions. The computer program instructions may be provided to processors of general-purpose computers, special-purpose computers, embedded processors or other programmable data processing terminal devices to generate a machine, such that instructions executed by the processors of computers or other programmable data processing terminal devices are generated for implementing specified functions of one or more flows in the flow charts and/or one or more blocks in the block diagrams.

The computer program instructions may also be stored in a computer readable storage that may guide a computer or other programmable data processing terminal device to operate in a specific way, so that instructions stored in the computer readable storage generate a manufacturer including an instruction device, which implements specified functions of one or more flows in the flow charts and/or one or more blocks in the block diagrams.

The computer program instructions may also be loaded onto a computer or other programmable data processing terminal device, enabling a series of operational steps to be performed on the computer or other programmable terminal device. Therefore, the instructions executed on the computer or other programmable terminal device implement specified functions of one or more flows in the flow charts and/or one or more blocks in the block diagrams.

Although preferred embodiments of the embodiments of the present disclosure have been described, once those skilled in the art have learned about basic creative concepts, they may make additional changes and modifications to these embodiments. Therefore, the appended claims are intended to be interpreted as including preferred embodiments and all changes and modifications falling within the scope of the embodiments of the present disclosure.

It should also be noted that, in the present disclosure, relational terms such as first and second are used only for distinguishing one entity or operation from another entity or operation, without necessarily requiring or implying any such actual relationship or order between these entities or operations. Moreover, term "include", "comprise" or any other variant thereof is intended to cover non-exclusive inclusions, so that a process, a method, an item or a terminal device that includes a series of elements includes not only those elements, but also other elements that are not explicitly listed, or inherent elements of the process, the method, the item or the terminal device. Without further restrictions, an element defined by a statement "comprising one . . . " does not exclude an existence of additional identical element in the process, the method, the item or the terminal device that includes the element.

The embodiments described above are optional embodiments of the present disclosure, and it should be pointed out that those skilled in the art may make various modifications and changes without departing from the spirit and the scope of the present disclosure. The modifications and changes shall also be regarded as the protection scope of the present disclosure.

What is claimed is:

1. An antenna circuit, comprising:

an antenna unit, a switching circuit connection point and a feed point being arranged on the antenna unit, an antenna feed connected with the feed point, a first tuning circuit connected with the switching circuit connection point, the first tuning circuit is configured to increase a bandwidth of a single resonant mode in an intermediate-high frequency and/or tune a resonant frequency in the intermediate-high frequency;

wherein a distance from the feed point to the end of the antenna unit is larger than a distance from the switching circuit connection point to the end of the antenna unit;

wherein the first tuning circuit comprises:

a first switch, a first inductor, a second inductor, a first capacitor and a first through line;

wherein a first terminal of the first inductor, a first terminal of the second inductor, a first terminal of the first capacitor and a first end of the first through line are connected at a first connection point, and the first connection point is grounded;

a first terminal of the first switch is connected with the switching circuit connection point, a second terminal of the first switch is connected with at least one of a second terminal of the first inductor, a second terminal of the second inductor, a second terminal of the first capacitor and a second end of the first through line or the second terminal of the first switch is not connected with any of the second terminal of the first inductor, the second terminal of the second inductor, the second terminal of the first capacitor and the second end of the first through line;

when the second terminal of the first switch is connected with at least one of the second terminal of the first inductor, the second terminal of the second inductor, the e terminal of the first capacitor and the second end of the first through line, the bandwidth of the single resonant mode in the intermediate-high frequency is increased;

when the second terminal of the first switch is connected with another one or more of the second terminal of the first inductor, the second terminal of the second inductor, the second terminal of the first capacitor and the second end of the first through line, the resonant frequency in the intermediate-high frequency is tuned.

2. The antenna circuit according to claim 1, further comprising:

a second tuning circuit, a first terminal of the second tuning circuit being connected with the feed point, and a second terminal of the second tuning circuit being connected with the antenna feed;

wherein, when the second terminal of the first switch is connected with at least one of the second terminal of the first inductor, the second terminal of the second inductor, the second terminal of the first capacitor and the second end of the first through line, the second tuning circuit is configured to tune the bandwidth of the intermediate frequency and/or the high frequency in non-carrier aggregation state and carrier aggregation state.

3. The antenna circuit according to claim 2, wherein the second tuning circuit comprises:

a second switch, a second capacitor and a second through line, wherein a first terminal of the second capacitor is connected with a first end of the second through line to form a second connection point, and the second connection point is connected with the antenna feed;

a first terminal of the second switch is connected with the feed point, and a second terminal of the second switch is connected with a second terminal of the second capacitor or a second end of the second through line;

wherein, when the second terminal of the first switch is connected with at least one of the second terminal of the first inductor, the second terminal of the second inductor, the second terminal of the first capacitor and the second end of the first through line, and the second terminal of the second switch is connected with the second end of the second through line, the antenna circuit operates in the non-carrier aggregation state.

4. The antenna circuit according to claim 3, wherein when the second terminal of the first switch is not connected with any of the second terminal of the first inductor, the second terminal of the second inductor, the second terminal of the first capacitor and the second end of the first through line, and the second terminal of the second switch is connected with the second terminal of the second capacitor, a resonant mode in a low frequency band is generated.

5. The antenna circuit according to claim 3, wherein when the second terminal of the first switch is connected with at least one of the second terminal of the first inductor, the second terminal of the second inductor, the second terminal of the first capacitor and the second end of the first through line, the antenna circuit further comprises:

a third inductor;

wherein a first terminal of the third inductor is connected with the antenna unit, and a second terminal of the third inductor is grounded;

the second terminal of the second switch is connected with the second terminal of the second capacitor, the antenna circuit operates in the carrier aggregation state, the third inductor and the second capacitor are configured to convert the single resonant mode into two resonant modes.

6. The antenna circuit according to claim 2, further comprising:

a third tuning circuit, a first terminal of the third tuning circuit being connected with the antenna unit, or the first terminal of the third tuning circuit being connected with the first terminal of the second capacitor, and a second terminal of the third tuning circuit being grounded;

wherein the third tuning circuit and the second capacitor are configured to generate two resonance modes in the low frequency band and an intermediate frequency band.

7. The antenna circuit according to claim 6, wherein the third tuning circuit comprises:

a third switch, a fourth inductor and a third capacitor;

wherein a first terminal of the third switch is connected with the antenna unit, or the first terminal of the third switch is connected with the first terminal of the second capacitor;

a second terminal of the third switch is connected to at least one of a first terminal of the fourth inductor and a first terminal of the third capacitor;

a second terminal of the fourth inductor and a second terminal of the third capacitor are connected to form a third connection point, and the third connection point is grounded.

8. The antenna circuit according to claim 6, further comprising:

a length adjusting inductor;

wherein a first terminal of the length adjusting inductor is connected with the feed point, and a second terminal of the length adjusting inductor is connected with the first terminal of the second capacitor.

9. The antenna circuit according to claim 4, further comprising:

a fourth tuning circuit, a first terminal of the fourth tuning circuit being connected with the antenna unit, and a second terminal of the fourth tuning circuit being grounded;

wherein the fourth tuning circuit and the second capacitor are configured to realize the low frequency and tune in the low frequency band.

10. The antenna circuit according to claim 6, further comprising:

a fourth tuning circuit, a first terminal of the fourth tuning circuit being connected with the antenna unit, and a second terminal of the fourth tuning circuit being grounded;

wherein the fourth tuning circuit and the second capacitor are configured to realize the low frequency and tune in the low frequency band.

11. The antenna circuit according to claim 9, wherein the fourth tuning circuit comprises:

a fourth switch, a fifth inductor, a sixth inductor and a fourth capacitor;

wherein a first terminal of the fifth inductor, a first terminal of the sixth inductor and a first terminal of the fourth capacitor are connected at a fifth connection point, and the fifth connection point is grounded;

a first terminal of the fourth switch is connected with the antenna unit, and a second end of the fourth switch is connected with at least one of a second terminal of the fifth inductor, a second terminal of the sixth inductor and a second terminal of the fourth capacitor.

12. The antenna circuit according to claim 10, wherein when the antenna circuit comprises the third tuning circuit, the third tuning circuit and the fourth tuning circuit are connected to a same location or different locations of the antenna unit;

wherein, when the third tuning circuit and the fourth tuning circuit are connected to the same location of the antenna unit, the third tuning circuit and the fourth tuning circuit are combined to form a first combined coordination circuit, the first combined coordination circuit comprises:

a first combined switch, a first combined inductor, a second combined inductor and a first combined capacitor;

a first terminal of the first combined inductor, a first terminal of the second combined inductor and a first terminal of the first combined capacitor are connected at a first combined connection point, and the first combined connection point is grounded;

a first terminal of the first combined switch is connected with the antenna unit, a second terminal of the first combined switch is connected with at least one of a second terminal of the first combined inductor, a second terminal of the second combined inductor and a second terminal of the first combined capacitor;

when the second terminal of the first combined switch is connected with the second terminal of the first combined capacitor, the first combined capacitor and the second capacitor are configured to generate two resonance modes in the low frequency band and the intermediate frequency band; the first combined inductor and the second combined inductor are configured to tune the resonance frequency in the low frequency band.

13. The antenna circuit according to claim 3, wherein when the second terminal of the first switch is connected with at least one of the second terminal of the first inductor, the second terminal of the second inductor, the second terminal of the first capacitor and the second end of the first through line, the antenna circuit further comprises:

a fifth tuning circuit;

wherein a first terminal of the fifth tuning circuit is connected with the antenna unit, and a second terminal of the fifth tuning circuit is grounded;

the fifth tuning circuit is configured to increase a tuning range of the intermediate-high frequency.

14. The antenna circuit according to claim 5, wherein when the second terminal of the first switch is connected with at least one of the second terminal of the first inductor, the second terminal of the second inductor, the second terminal of the first capacitor and the second end of the first through line, the antenna circuit further comprises:

a fifth tuning circuit;

wherein a first terminal of the fifth tuning circuit is connected with the antenna unit, and a second terminal of the fifth tuning circuit is grounded;

the fifth tuning circuit is configured to increase a tuning range of the intermediate-high frequency.

15. The antenna circuit according to claim 13, wherein the fifth tuning circuit comprises:

a fifth switch, a seventh inductor and a fifth capacitor;

wherein a first terminal of the seventh inductor is connected with a first terminal of the fifth capacitor to form a sixth connection point, and the sixth connection point is grounded;

a first terminal of the fifth switch is connected with the antenna unit, and a second terminal of the fifth switch is connected with at least one of a second terminal of the seventh inductor and a second terminal of the fifth capacitor.

16. The antenna circuit according to claim 14, wherein when the antenna circuit comprises the third inductor, the third inductor and the fifth tuning circuit are connected to a same location or different locations of the antenna unit;

wherein, when the third inductor and the fifth tuning circuit are connected to the same location of the antenna unit, the third inductor and the fifth tuning circuit are combined to form a second combined coordination circuit, the second combined coordination circuit comprises:

a second combined switch, a third combined inductor, a fourth combined inductor and a second combined capacitor;

a first terminal of the third combined inductor, a first terminal of the fourth combined inductor and a first terminal of the second combined capacitor are connected at a second combined connection point, and the second combined connection point is grounded;

a first terminal of the second combined switch is connected with the antenna unit, a second terminal of the second combined switch is connected with at least one of a second terminal of the third combined inductor, a second terminal of the fourth combined inductor and a second terminal of the second combined capacitor.

17. The antenna circuit according to claim 1, wherein the distance from the feed point to the end of the antenna unit ranges from 15 mm to 30 mm, and the distance from the switching circuit connection point to the end of the antenna unit ranges from 5 mm to 18 mm.

18. A mobile terminal, comprising the antenna circuit according to claim 1.

19. The mobile terminal according to claim 18, wherein the mobile terminal comprises at least one of a mobile phone, a tablet computer, a personal digital assistant and a vehicle computer.

* * * * *